United States Patent [19]

Meredith et al.

[11] 4,303,470

[45] Dec. 1, 1981

[54] METHOD AND APPARATUS FOR MIXING GASES WITH A WOOD PULP SLURRY

[75] Inventors: Michael D. Meredith, Federal Way; Jozef M. Bentvelzen, Sumner, both of Wash.; Henry Bepple, Kamloops, Canada

[73] Assignee: Weyerhaeuser Company, Tacoma, Wash.

[21] Appl. No.: 48,939

[22] Filed: Jun. 15, 1979

[51] Int. Cl.[3] ..... D21C 9/10; D21D 5/28

[52] U.S. Cl. ..... 162/57; 68/5 B; 162/68; 162/243

[58] Field of Search ..... 366/102, 103, 104, 107, 366/303, 157, 167, 178; 68/5 C, 5 D, 5 B, 5 R, 181 R, 183; 162/24, 65, 243, 57, 60, 89, 90, 23, 78; 8/156, 149.1, 109, 111

[56] References Cited

U.S. PATENT DOCUMENTS

| | | | |
|---|---|---|---|
| 1,827,710 | 10/1931 | Leyst-Kuchenmeister | 162/57 |
| 3,293,117 | 12/1966 | Pennington | 162/243 |
| 3,769,152 | 10/1973 | Samuelson et al. | 162/65 |
| 4,023,737 | 3/1976 | Leider et al. | 241/261.3 |
| 4,039,154 | 8/1977 | Peterson | 241/261.3 |
| 4,082,233 | 4/1978 | Reinhall | 162/24 |
| 4,093,506 | 6/1978 | Richter | 162/65 |

OTHER PUBLICATIONS

"The Asplund RL 50 S Raffinator Defibrator", Oct. 1971.

"Rauma-Repola Double Shaft Mixer", Bulletin.

Kleppe et al., "Oxygen/alkali delignification at Kamyr digester blowline consistency"-A Status Report TAPPI Nov. 76, vol. 59, No. 11.

Rapson, "The Bleaching of Pulp" TAPPI Monograph No. 27, 1963, p. 332, FIGS. 15-22.

*Primary Examiner*—S. Leon Bashore
*Assistant Examiner*—Steve Alvo
*Attorney, Agent, or Firm*—Weyerhaeuser Company

[57] ABSTRACT

Process and apparatus for mixing a wood pulp slurry with a chemical at the consistency at which the slurry exits a washer or the subsequent steam mixer, 7 to 15%. The chemicals would include noncondensable or unsaturated gases such as oxygen, ozone, air, chlorine, chlorine dioxide, sulfur dioxide, ammonia, nitrogen, carbon dioxide, hydrogen chloride, nitric oxide or nitrogen peroxide. Highly superheated steam can also be mixed with the pulp.

In the process, the pulp slurry would pass through a mixing zone having a swept area in the range of 10,000 to 1,000,000 square meters per metric ton of oven-dry pulp. The preferred range is 25,000 to 150,000 square meters per metric ton of oven-dry pulp and the optimum is considered to be around 65,400 square meters per metric ton of oven-dry pulp.

The pulp slurry passes through an annular mixing zone. Specific designs of the various elements of the mixer are disclosed.

73 Claims, 33 Drawing Figures

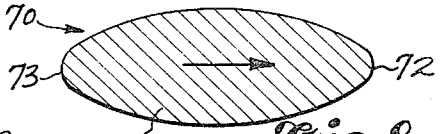
Fig. 8
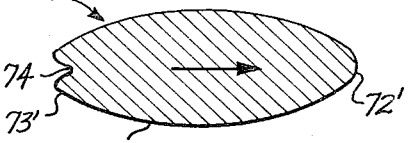
Fig. 10
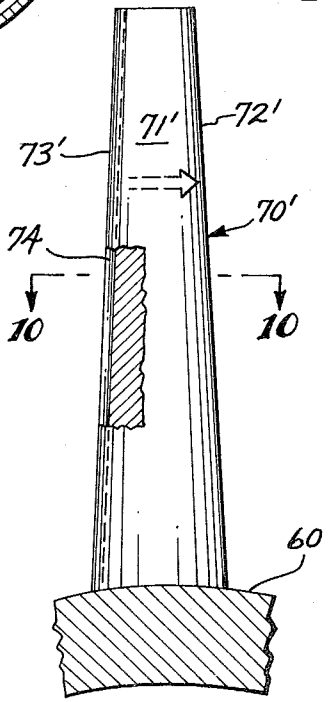
Fig. 9
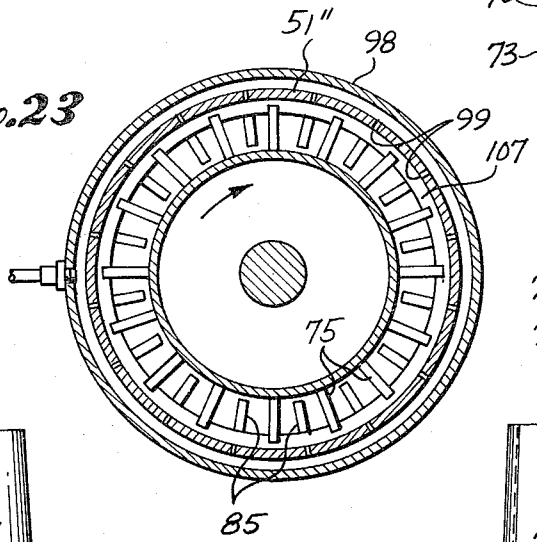
Fig. 23
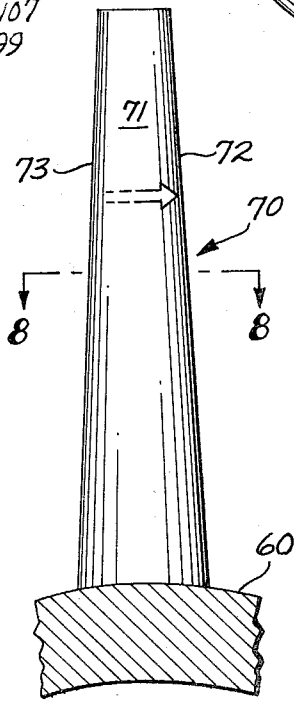
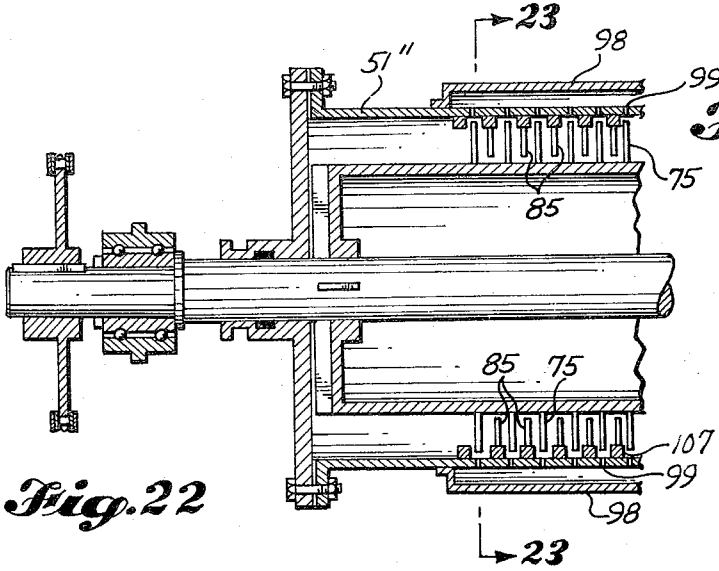
Fig. 22
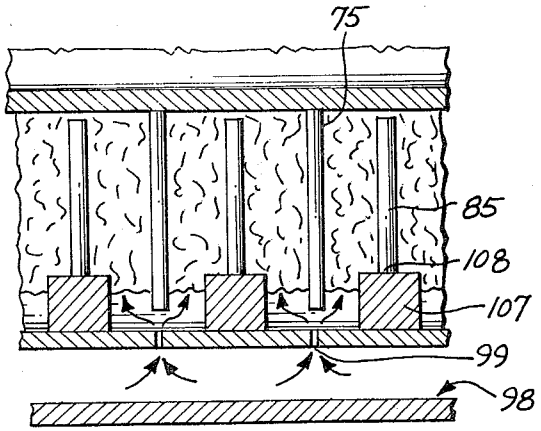
Fig. 7
Fig. 24

METHOD AND APPARATUS FOR MIXING GASES WITH A WOOD PULP SLURRY

BACKGROUND OF THE INVENTION

1. Field of the Invention

Apparatus and process for mixing chemicals with wood pulp.

2. Review of the Prior Art

The following definitions will be used in this application.

Pulping is the changing of wood chips or other wood particulate matter to fibrous form. Chemical pulping requires cooking of the chips in solution with a chemical, and includes partial removal of the coloring matter such as lignin associated with the wood.

Bleaching is the treatment of cellulosic fibers to remove or alter the coloring matter associated with the fibers to allow the fiber to reflect white light more truly.

The standard symbols for pulping and bleaching sequences are:

S=Sulfite
K=Kraft
So=Soda
C=Chlorine
H=Sodium or calcium hypochlorite
E=Alkali extraction, usually with sodium hydroxide
D=Chlorine dioxide
P=Alkaline peroxide
O=Oxygen
A=Acid pretreatment or part treatment Consistency is the amount of pulp fiber in a slurry, expressed as a percentage of the total weight of the oven dry fiber and the solvent, usually water. It is sometimes called pulp concentration.

The consistency of the pulp will depend upon the type of dewatering equipment used. The following definitions are based on those found in Rydholm *Pulping Processes,* Interscience Publishers, 1965, pages 862–863 and TAPPI Monograph No. 27, *The Bleaching of Pulp,* Rapson editor, The Technical Association of Pulp and Paper Industry, 1963, pages 186–187.

Low consistency is from 0–6%, usually between 3 and 5%. It is a suspension that is pumpable in an ordinary centrifugal pump and is obtainable using deckers and filters without press rolls.

Medium consistency is between 6 and 20%. Fifteen percent is a dividing point within the medium-consistency range. Below 15% the consistency can be obtained by filters. This is the consistency of the pulp mat leaving the vacuum drum filters in the brownstock washing system and the bleaching system. The consistency of a slurry from a washer, either a brownstock washer or a bleaching stage washer, is 9–13%. Above 15%, press rolls are needed for dewatering. Rydholm states that the usual range for medium consistency is 10–18%, while Rapson states it is 9–15%. The slurry is pumpable by special machinery even though it is still a coherent liquid phase at higher temperatures and under some compression.

High consistency is from 20–40%. Rydholm states that the usual range is 25–35% and Rapson states that the range is from 20–35%. These consistencies are obtainable only by presses. The liquid phase is completely absorbed by the fibers, and the pulp can be pumped only very short distances. For practical purposes, it is non-pumpable.

Pulp quantity is expressed in several ways.

Oven-dry pulp is considered to be moisture free or bone dry. Its value is determined by drying the pulp in an oven at a temperature of 100° to 105° C. until it reaches constant weight. It usually is considered to have reached constant weight after 24 hours in the oven.

Air-dry pulp is assumed to have a ten percent moisture content. One air-dry ton of pulp is equal to 0.9 oven-dry tons of pulp.

There are two principal types of measurements to determine the completeness of the pulping or bleaching process, the degree of delignification and the brightness of the pulp. There appears to be no correlation between the two because the delignification factor is a measure of residual lignin within the pulp and the brightness is a measure of reflectivity of the pulp sheet.

There are many methods of measuring the degree of delignification of the pulp but most are variations of the permanganate test.

The normal permanganate test provides a permanganate or K number—the number of cubic centimeters of tenth normal potassium permanganate solution consumed by one gram of oven dry pulp under specified conditions. It is determined by TAPPI Standard Test T-214.

The Kappa number is similar to the permanganate number but is measured under carefully controlled conditions and corrected to be the equivalent of a 50% consumption of the permanganate solution in contact with the specimen. The test gives the degree of delignification of pulps through a wider range of delignification than does the permanganate number. It is determined by TAPPI Standard Test T-236.

PBC is also a permanganate test. The test is as follows:

1. Slurry about 5 hand-squeezed grams of pulp stock in a 600-milliliter beaker and remove all shives.
2. Form a hand sheet in a 12.5-centimeter Buckner funnel, washing with an additional 500 milliliters of water. Remove the filter paper from the pulp.
3. Dry the hand sheet for 5 minutes at 99° to 104° C.
4. Remove the hand sheet and weigh 0.426 grams of it. The operation should be done in a constant time of about 45 seconds to ensure the moisture will be constant, since the dry pulp absorbs more moisture.
5. Slurry the weighed pulp sample in a 1-liter beaker containing 700 milliliters of 25° C. tap water.
6. Add 25 milliliters of 4 N sulphuric acid and then 25 milliliters of 0.1000 N potassium permanganate. Start the timer at the start of the permanganate addition.
7. Stop the reaction after exactly 5 minutes by adding 10 milliliters of the 5% potassium iodide solution.
8. Titrate with 0.1000 N sodium thiosulfate. Add a starch indicator near the end of the titration when the solution becomes straw color. The end point is when the blue color disappears.

In running the test, the thiosulfate should first be added as rapidly as possible to prevent the liberation of free iodine. During the final part of the titration the thiosulfate is added a drop at a time until the blue color just disappears. The titration should be completed as rapidly as possible to prevent reversion of the solution from occurring.

The PBC number represents the pounds of chlorine needed to completely bleach one hundred pounds of air dried pulp at 20° C. in a single theoretical bleaching stage and is equal to the number of milliliters of potassium permanganate consumed as determined by subtracting the number of milliliters of thiosulfate consumed from the number of milliliters of potassium permanganate added.

Many variables affect the test, but the most important are the sample weight, the reaction temperature and the reaction time.

There are also a number of methods of measuring pulp brightness. It usually is a measure of reflectivity and its value is expressed as a percent of some scale. A standard method is GE brightness which is expressed as a percentage of a maximum GE brightness as determined by TAPPI Standard Method TPD-103.

Another measure of the brightness or delignification is the opacity of the fiber. Opacity as a percent of a standard is determined by TAPPI Standard Test T 425 OS-75.

Pulp yield may be measured in two ways. The first is the amount, by weight, of carbohydrates and lignin returned per unit of wood. Screened yield is closely related and proportional to this chemical return. A high screened yield means the chemical return is high and a low screened yield means the chemical return is low. The second measurement of yield is fiber yield, by weight, per unit of wood. Rejects or screenings are related to and inversely proportional to the fiber yield. A high reject level means there is a low fiber return and a low reject level means there is a high fiber return. The total yield is the sum of these two yields. The ideal situation would be one in which there is a high chemical return and a high fiber return indicated by a high screened yield and low screenings.

There are a great number of devices for mixing wood pulp with chemicals. The following are exemplary.

The process disclosed in the International Paper patents to Roymoulik et al, U.S. Pat. No. 3,832,276, which issued Aug. 27, 1974, and to Phillips, U.S. Pat. No. 3,951,733, which issued Apr. 20, 1976 requires a pulp at a consistency of less than 10 percent, preferably about 2 to 6 percent and most desirably between 3 and 4 percent. The pulp is mixed with oxygen in a high shear mixing device and the slurry is introduced into a vessel. The slurry rises upward through the vessel. There is no substantial agitation of the fibers as they travel upward and the pressure on the pulp is gradually reduced. The maximum pressure difference is between 1 and 10 atmospheres. This is preferably done in a bleach tower having a height of between 40 and 300 feet.

"Generally speaking from about 5 to 120 minutes is sufficient. For the higher initial pressure provided by the higher tower the time can be reduced to a period of from about 1 minute to 60 minutes. With a 40 foot tower providing a pressure differential of roughly about 1 atmosphere about 30 to 60 minutes, preferably about 40 minutes is satisfactory."

The oxygenated pulp does not go directly to the tank. Between the mixer and the tank are a heat exchanger 5, a vent 7, and, optionally, a prepressurizing chamber 6.

The Rauma-Repola system is described in the Federal Republic of Germany patent disclosure No. 24 41 579, Mar. 13, 1975 and in Yrjala et al, New Aspects in Oxygen Bleaching, dated Apr. 18, 1974. The system uses the Vortex mixer shown in FIGS. 2 and 3 of the patent. It is possible, by using either a number of passes through a single mixer or several mixers in series, to bleach the pulp in from 5 to 15 minutes. The consistency is 3%.

Yrjala, et al. "A new reactor for pulp bleaching" Kemian Teollisuus 29, No. 12: 861–869 (1972) describes a chlorine reactor.

Richter U.S. Pat. No. 4,093,506 describes a mixer for mixing bleaching fluids such as chlorine or chlorine dioxide with pulp. Rapidly rotating rotor blades essentially fluidize the pulp and the treatment gas is then added to it. The Kamyr reactor is also described in an article, "Pilot and Commercial Results of Medium Consistency Chlorination," given at the Bleaching Seminar on Chlorination and Caustic Extraction, Nov. 10, 1977 in Washington, D.C.

The TAPPI monograph "The Bleaching of Pulp" describes and shows on pp. 325 and 332, respectively, single-shaft and double-shaft steam mixers. A steam mixer has a swept area of around 6500 square meters per metric ton of oven-dry pulp.

Reinhall U.S. Pat. No. 4,082,233 discloses a refiner having means for removing excess gas before the stock enters the refiner.

SUMMARY OF THE INVENTION

It has been difficult to add oxygen to pulp at the consistencies at which it exits the washer. It has also been difficult to be able to mix oxygen in a short period of time. Most of the prior art required either long time spans or a great amount of capital equipment.

The inventors decided it was necessary to shorten the time of reaction to provide equipment that was not capital intensive, and to operate at consistencies usually found in a pulping and bleaching system to reduce the horsepower required to operate the system. Pulp usually leaves the washer or subsequent steam mixer at consistencies of around 7 to 15%. It has the same consistency at other places within the pulp mill. They proceeded to attempt mixing with equipment that was more suited to a normal pulp mill environment, could be easily inserted into the pulp mill without major modifications of the equipment presently in the mill, and required less power to operate. In doing this, they determined that the amount of swept area, the area swept by the rotors while the pulp slurry is passing through the mixer, is important. This area is defined by the formula $$A=[1440\pi(r_1^2-r_2^2)(R)(N)]/t$$

where

A = area swept per metric ton, $m^2/t$
$r_1$ = outer radius of the rotor, m
$r_2$ = inner radius of the rotor, m
R = revolutions per minute of the rotor
N = number of rotors
t = metric tons (Oven Dry Basis) of pulp passing through the mixer per day.

They discovered that the swept area should be in the range of 10,000 to 1,000,000 square meters per metric ton of oven-dry pulp. They determined that within this range there was a range of 25,000 to 150,000 square meters per metric ton of oven-dry pulp which had certain characteristics that were better: less power was required or the kinetics of the reaction were substantially better. The optimum swept area is around 65,400 square meters per metric ton of oven-dry pulp.

It was also determined that the oxygen should be placed within the pulp slurry in the mixing zone. The oxygen should preferably be supplied incrementally to the pulp as it passes through the mixer. This is done by multiple additions of the chemical through the stators which extend into the pulp slurry and reduce the rotation of the pulp slurry as it passes through the mixing zone.

The rotors which provide the swept area within the slurry have leading and trailing edges with radii of curvature of 0.5 to 15 mm. Although the radii of curvature of the leading and trailing edge usually are the same, they need not be. The rotor preferably should have a cross section having a shape that is elliptically generated, preferably elliptical, with its major axis in the direction of rotation. It should also be tapered. The trailing edge of the rotor may have a groove within it, and the groove may be treated with a hydrophobic coating.

It was also discovered that the central shaft in the mixer should have a diameter of about one half of the total interior diameter of the mixer to provide an annular space through which the pulp slurry would pass while being treated. There is a better reaction when the shaft has a diameter that is at least one half of the inner diameter of the mixer than when a shaft which has a smaller diameter.

Though the mixer was originally designed to overcome a problem in the oxygenation of pulp, it is also useful for noncondensable gases such as ozone, air, chlorine, chlorine dioxide, sulfur dioxide, ammonia, nitrogen, carbon dioxide, hydrogen chloride, nitric oxide and nitrogen peroxide. These gases may also be described as unsaturated in that they will not condense into liquid but will be superheated even after contact with the pulp. The mixer may also be used to mix highly superheated steam with the pulp.

BRIEF DESCRIPTION OF THE DRAWINGS

FIG. 7 is a plan view of a rotor.

FIG. 8 is a cross section of the rotor taken along line 8—8 of FIG. 7.

FIG. 9 is a plan view, partially in cross section, of a modified rotor.

FIG. 10 is a cross section of the modified rotor taken along line 10—10 of FIG. 9.

FIG. 22 is a cross section of another modification of the mixer.

FIG. 23 is a cross section of the modified mixer taken along line 23—23 of FIG. 22.

FIG. 24 is an enlarged cross section of the interior of the mixer shown in FIG. 22.

DESCRIPTION OF THE PREFERRED EMBODIMENT

Figure 1:
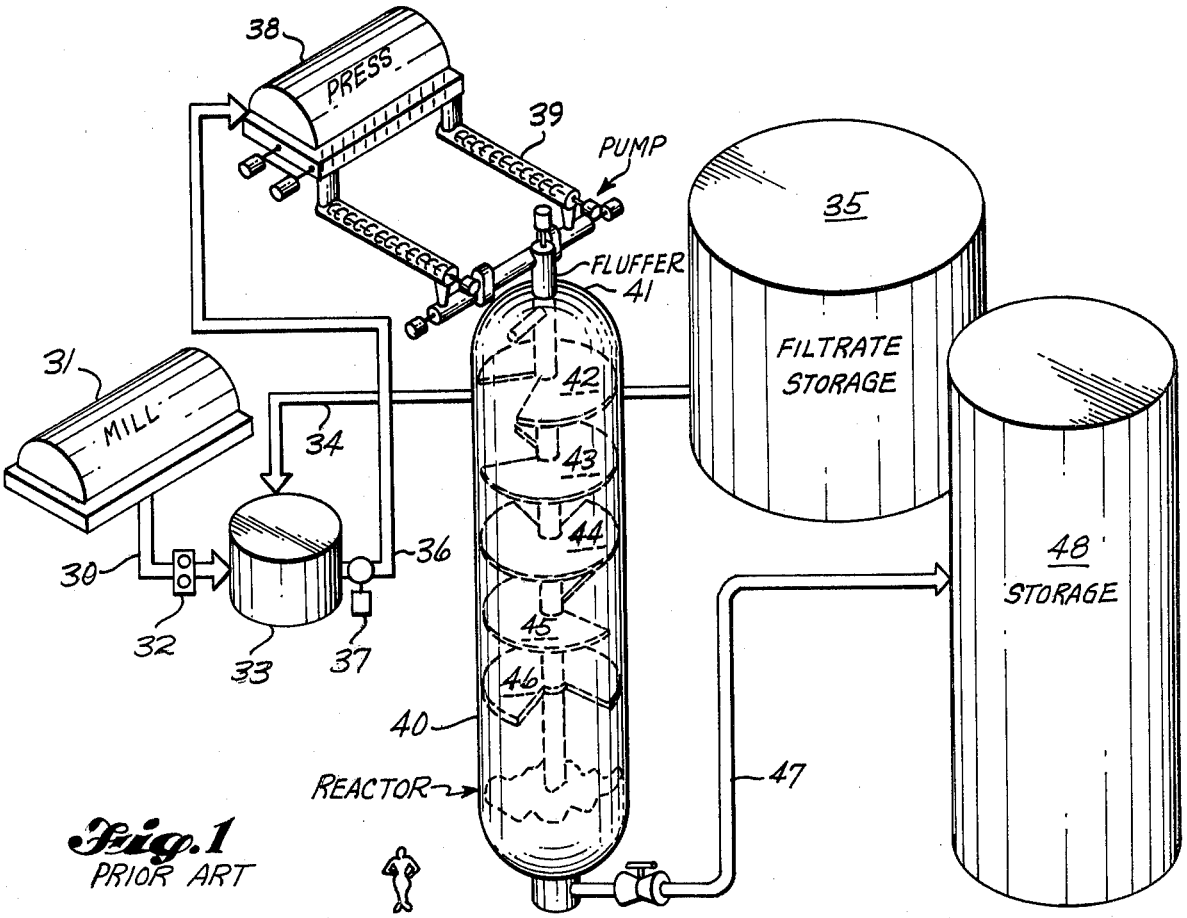
Fig. 1 PRIOR ART
FIG. 1 is a view of a prior art oxygen bleaching system.
Figure 2:
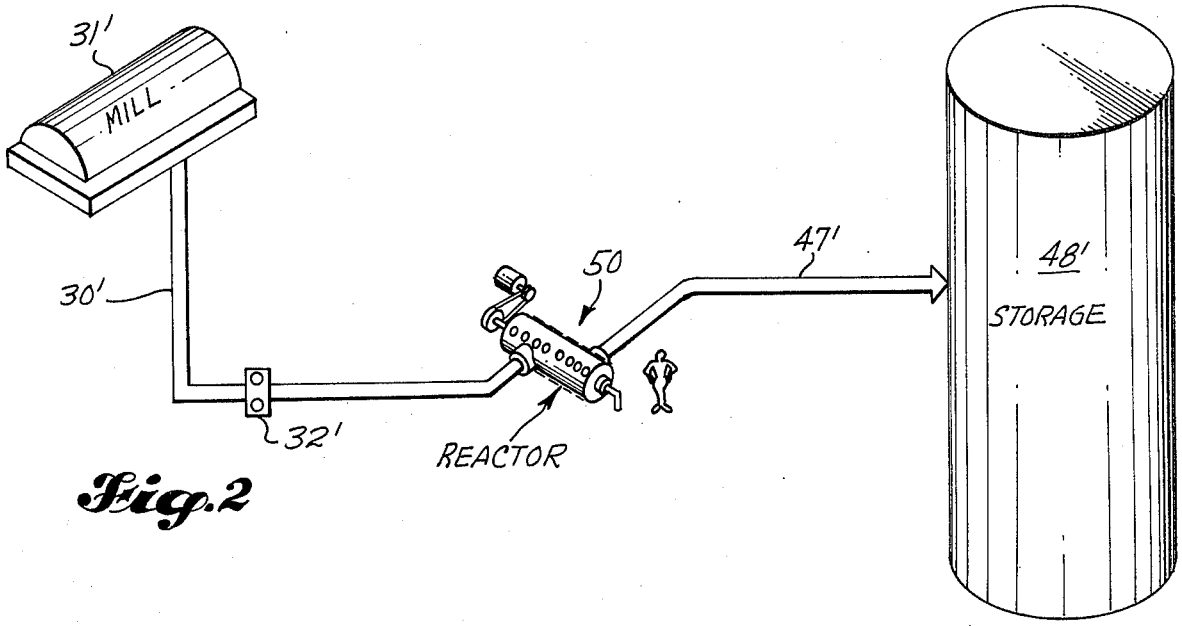
FIG. 2 is a view of the present mixer in the system of FIG. 1.
Figure 3:
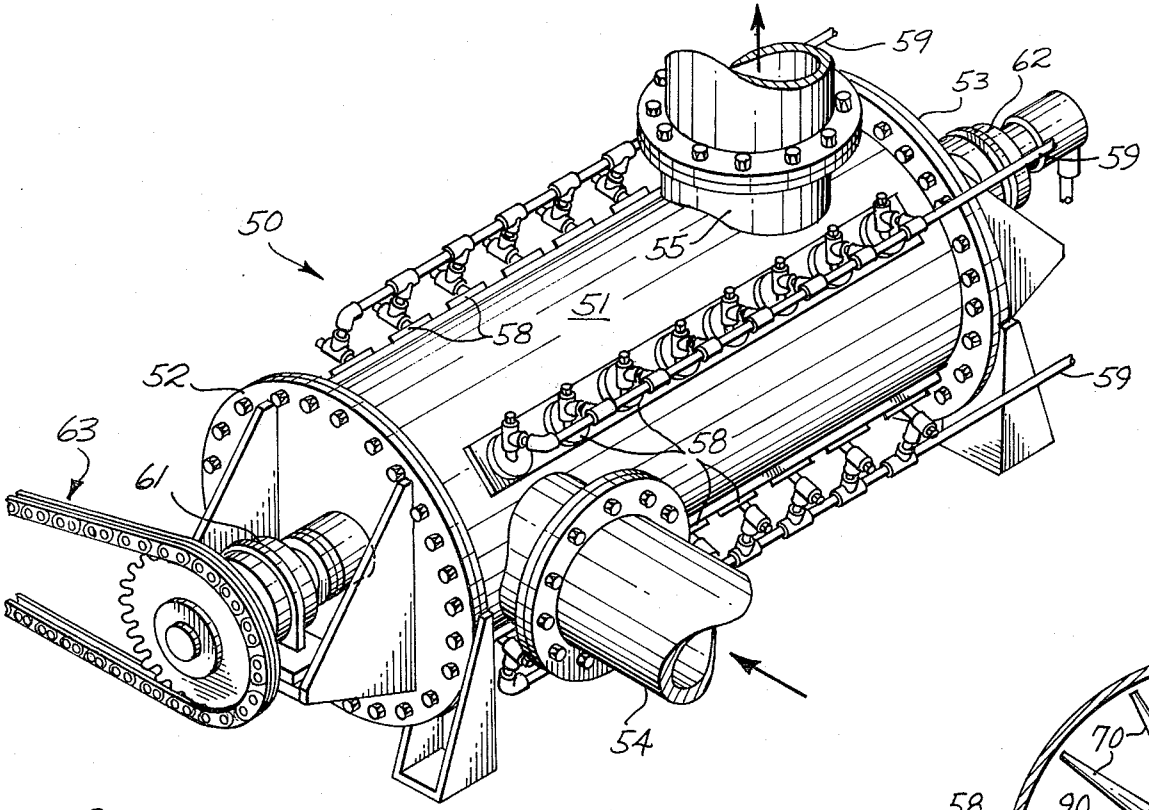
FIG. 3 is an isometric view of a mixer.
Figure 5:
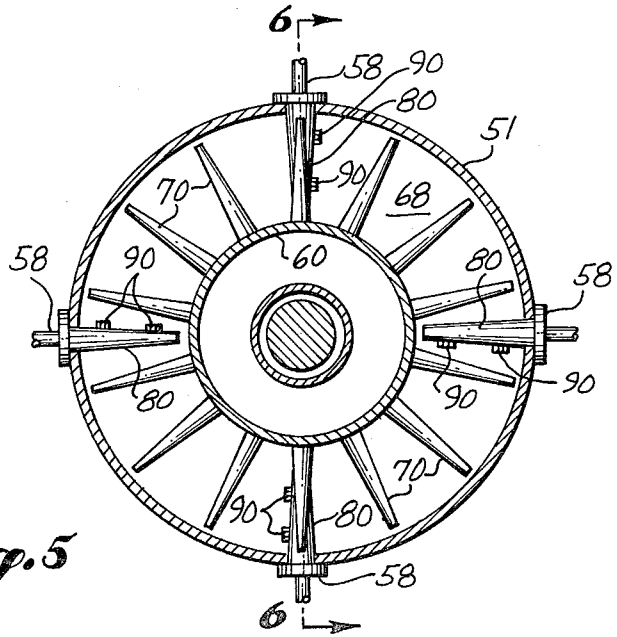
FIG. 5 is a cross section of the mixer along line 5—5 of FIG. 4.
Figure 4:
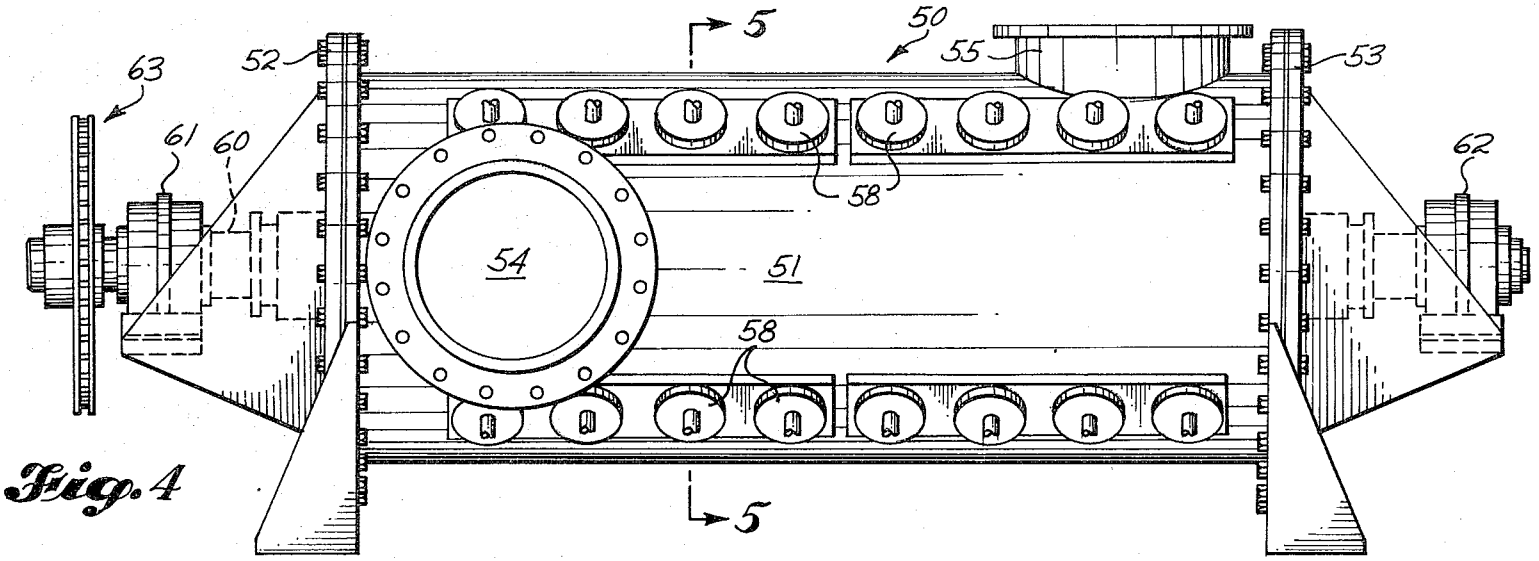
FIG. 4 is a side plan view of the mixer shown in FIG. 3.
Figure 6:
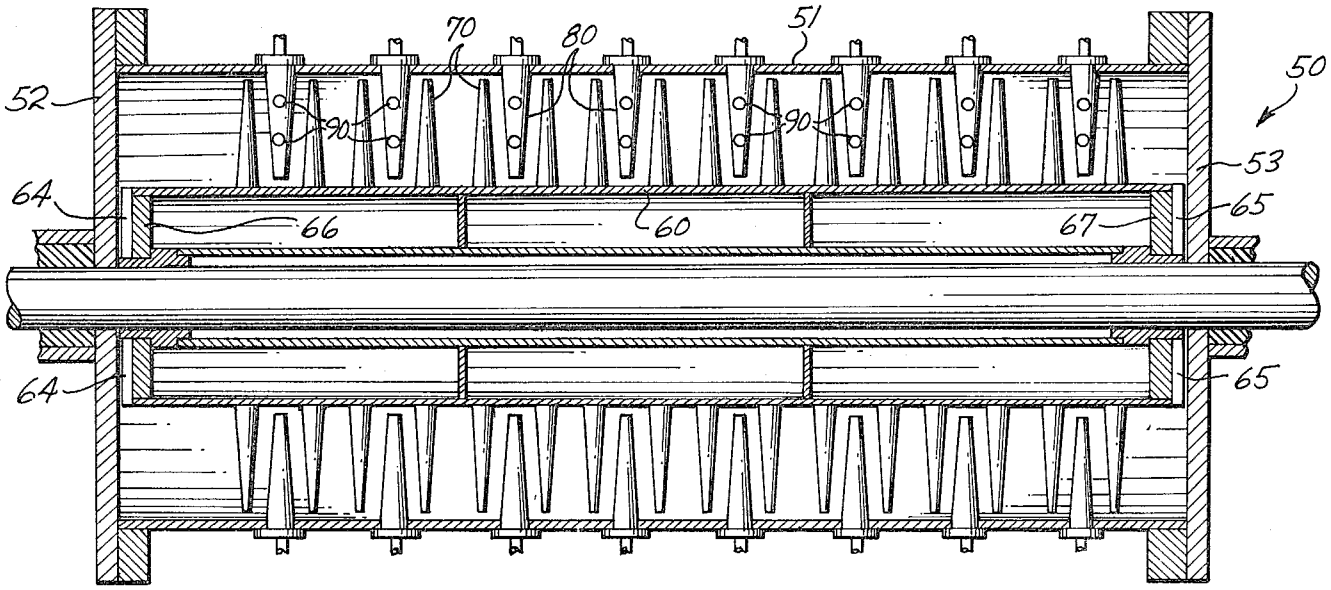
FIG. 6 is a cross section of the mixer taken along line 6—6 of FIG. 5.
Figure 19:
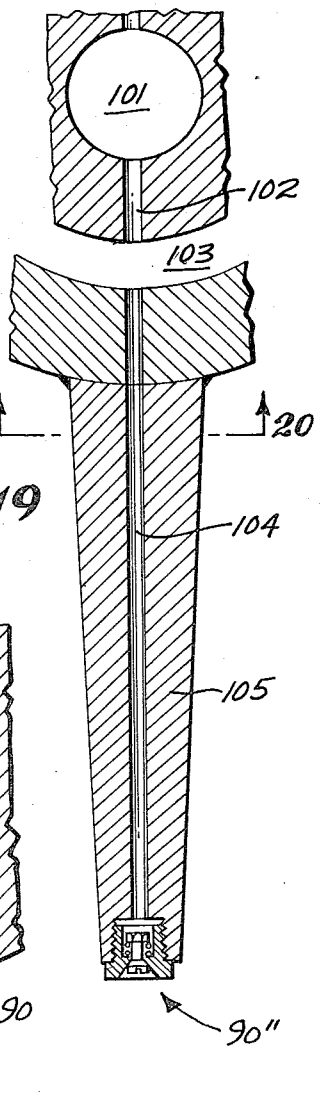
FIG. 19 is a cross section of a rotor used in the mixer of FIGS. 15-18.
Figure 20:
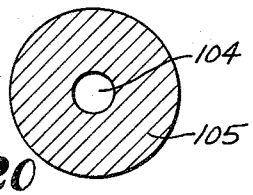
FIG. 20 is a cross section of the rotor taken along line 20—20 of FIG. 19.

FIGS. 1 and 2 compare the size and complexity of a prior art oxygen bleaching system of the type shown in Verreyne, et al. U.S. Pat. No. 3,660,225 with the present system. Both drawings are to the same scale. Both units would handle the same amount of pulp on an oven-dry weight basis.

In the prior art system shown in FIG. 1, pulp 30 from mill 31 is carried by pump 32 to a storage tank 33. In storage tank 33 the pulp is mixed with an alkali solution 34 from filtrate storage tank 35. A protector would be added to the pulp at this time also. The treated pulp mixture 36 is moved by pump 37 to a dewatering press 38 which removes enough water from the pulp to raise the consistency of the pulp slurry to around 20-30%. This material is then carried by pump 39 to the top of the oxygen reactor 40. The pump 39 is a series of screw conveyers, the only way to pressurize pulp of this consistency. At the top of the reactor 40 is a fluffer 41 which spreads the pulp uniformly over the top tray 42 of the reactor. The pulp passes down through the other trays 43-46 and is treated with oxygen during its passage through the trays. From the bottom of the trays the bleached pulp 47 is carried to storage tank 48.

This mill should be contrasted to the present system shown in FIG. 2. The mixing tank 33, filtrate storage tank 35, press 38, pump 39 and reactor 40 have been replaced by a simple mixer 50 in which the oxygen is mixed with the pulp 30'.

By comparison, the system of FIG. 1 requires a power six times as large as the mixer or system of FIG. 2. For the same quantity of pulp, the system of FIG. 1 would require an aggregate of 2238 kW to operate the reactor and the various pieces of equipment associated with the reactor, while the mixer of FIG. 2 would require a 373 kW motor.

The mixer of FIG. 2 is also able to operate at consistencies usually found in pulping and bleaching systems. This would usually be the consistency of pulp leaving the washer or the subsequent steam mixer, a consistency of around 8 to 15% from the washer and around 1% less from the steam mixer.

The mixer 50 has a cylindrical body 51 and two head plates 52 and 53. The pulp slurry enters through pipe 54, passes through the body of the mixer and exits through pipe 55. The oxygen manifolds 58, which supply oxygen to the stators 80 within the mixer, are supplied by oxygen lines 59.

A shaft 60 extends longitudinally of the mixer and is supported on bearings 61 and 62 and is rotated by rotational means 63. A chain belt drive is shown, but any other type of rotational means may be used.

Rotors 70 are attached to the shaft 60. A typical rotor construction is shown in FIGS. 7–8. The rotor 70 has a body 71 which is tapered outwardly from the shaft and has an elliptically generated cross section. The preferred cross section is an ellipse. The major axis of the rotor is aligned with the direction of rotation of the rotor. Each of its leading and trailing edges 72 and 73 has a radius of curvature in the range of 0.5 to 15 mm. The radii are usually the same, though they need not be. If different, then the leading edge would have a greater radius than the trailing edge.

A modification is shown in FIGS. 9–10. A groove 74 is formed in the trailing edge 73' of the rotor. The groove is about 0.1 mm across. The groove may be coated with a hydrophobic material.

The number of rotors and the speed of the rotors will depend on the amount of pulp passing through the mixer and the consistency of the pulp passing through the mixer. The area swept by the rotors should be in the range of 10,000 to 1,000,000 square meters per metric ton of oven-dry pulp. The preferred range is 25,000 to 150,000 square meters per metric ton of oven-dry pulp. The optimum is considered to be around 65,400 square meters per metric ton of oven-dry pulp. This area is determined by the formula $$A=[1440\pi(r_1^2-r_2^2)(R)(N)]/t$$

where

A = area swept per metric ton, $m^2/t$ $r_1$ = outer radius of the rotor, m $r_2$ = inner radius of the rotor, m R = revolutions per minute of the rotor N = number of rotors t = metric tons (Oven Dry Basis) of pulp passing through the mixer per day.

There is a trade-off between the length of the individual rotors and the number of rotors. The rotors are usually arranged in rings on the central shaft. The number of rotors in a ring will depend upon the circumference of the central shaft and the size of the rotor base. A greater number of rotors would require a longer and stiffer shaft. Fewer rotors would require longer rotors. Consequently, space for the mixer would determine the actual rotor configuration. Normally, there are a total of 4 to 400 rotors, and from 2 to 20 rotors in a ring.

The rotors rotate transversely to the direction of pulp movement through the mixer, describing a helical path through the pulp. The speed of rotation of the rotors would be determined by the motor, and the drive ratio between the motor and the shaft.

The diameter of the central shaft 60 is at least one half of the internal diameter of the mixer, forming an annular space 68 through which the slurry passes.

The enlarged shaft requires scraper bars 64 and 65 on shaft ends 66 and 67. There normally would be four bars on each end. The bars remove fibers that tend to build up between the shaft and the mixer head plate. This prevents binding of the shaft in the mixer.

Figure 12:
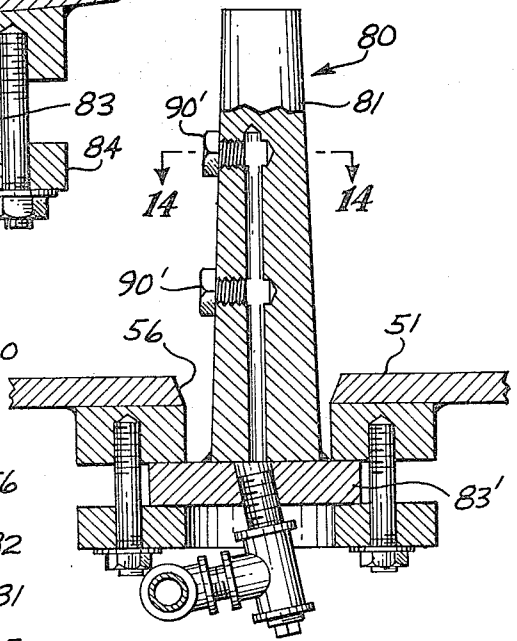
FIG. 12 is a side plan view, partially in cross section, of a modified stator taken along a line corresponding to line 12—12 of FIG. 11.
Figure 11:
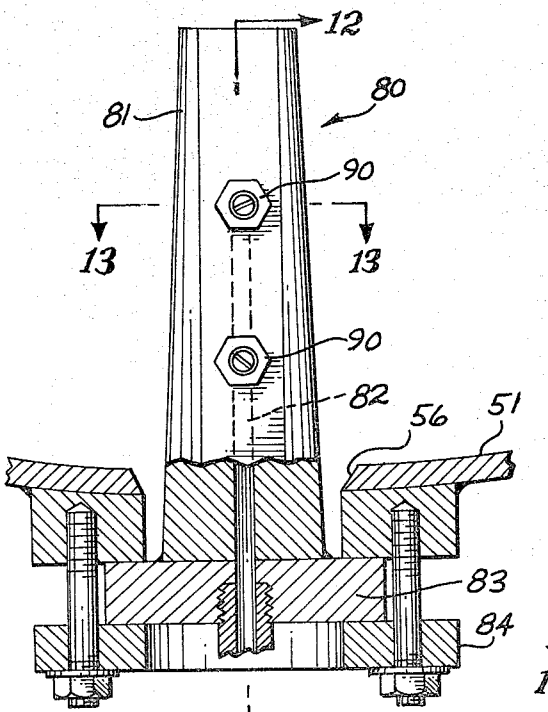
FIG. 11 is a plan view, partially in cross section, of a stator which may be used with the mixer.
Figure 13:
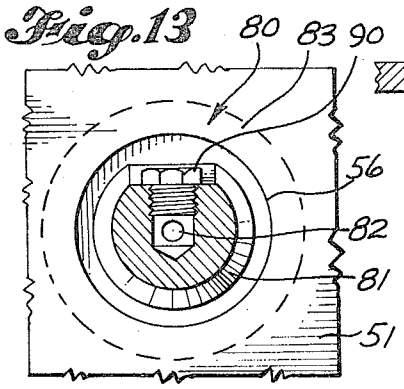
FIG. 13 is a cross section of the stator taken along line 13—13 of FIG. 11.
Figure 15:
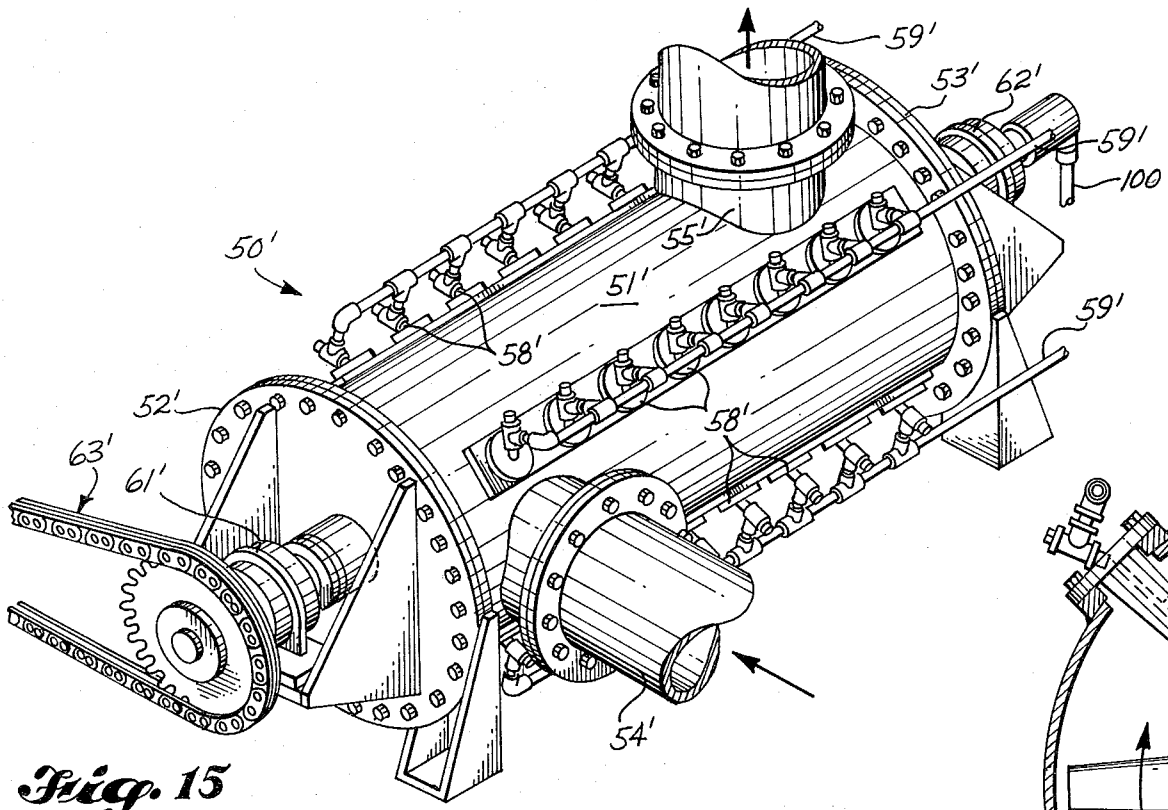
FIG. 15 is an isometric view of a modified mixer.
Figure 17:
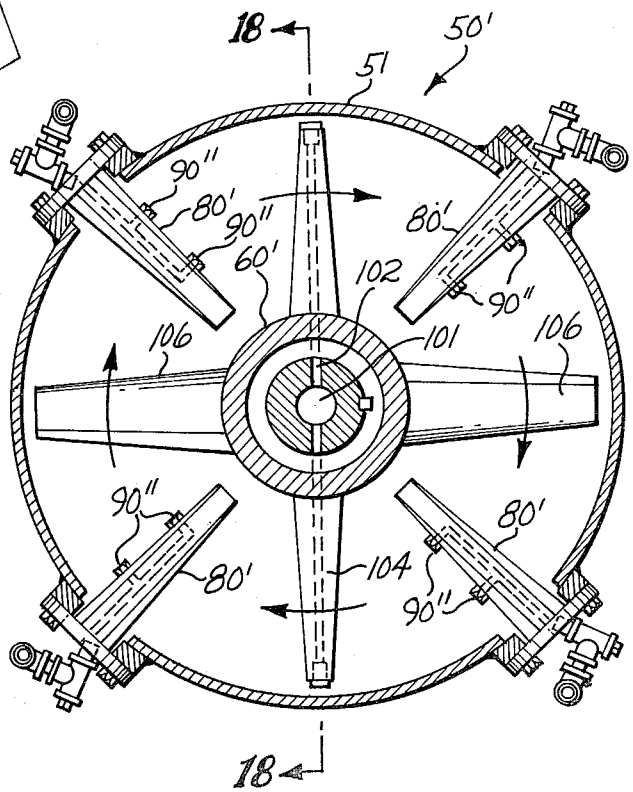
FIG. 17 is a cross section of the mixer taken along line 17—17 of FIG. 16.
Figure 16:
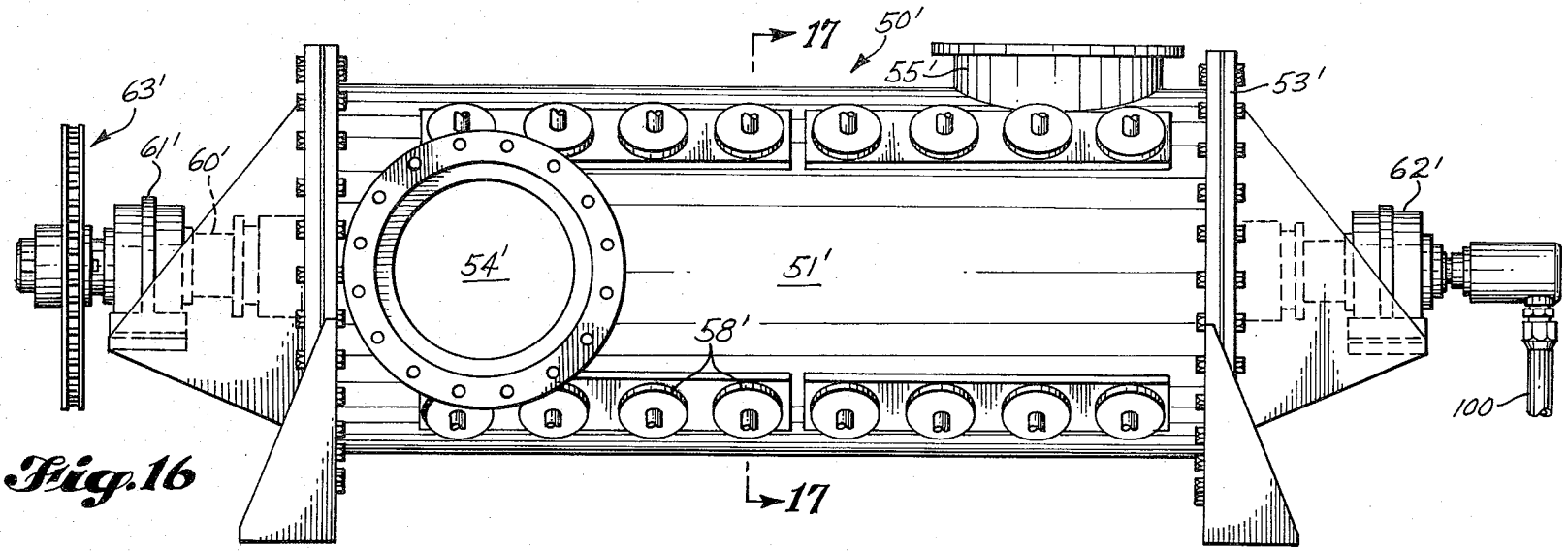
FIG. 16 is a side plan view of the mixer of FIG. 15.
Figure 18:
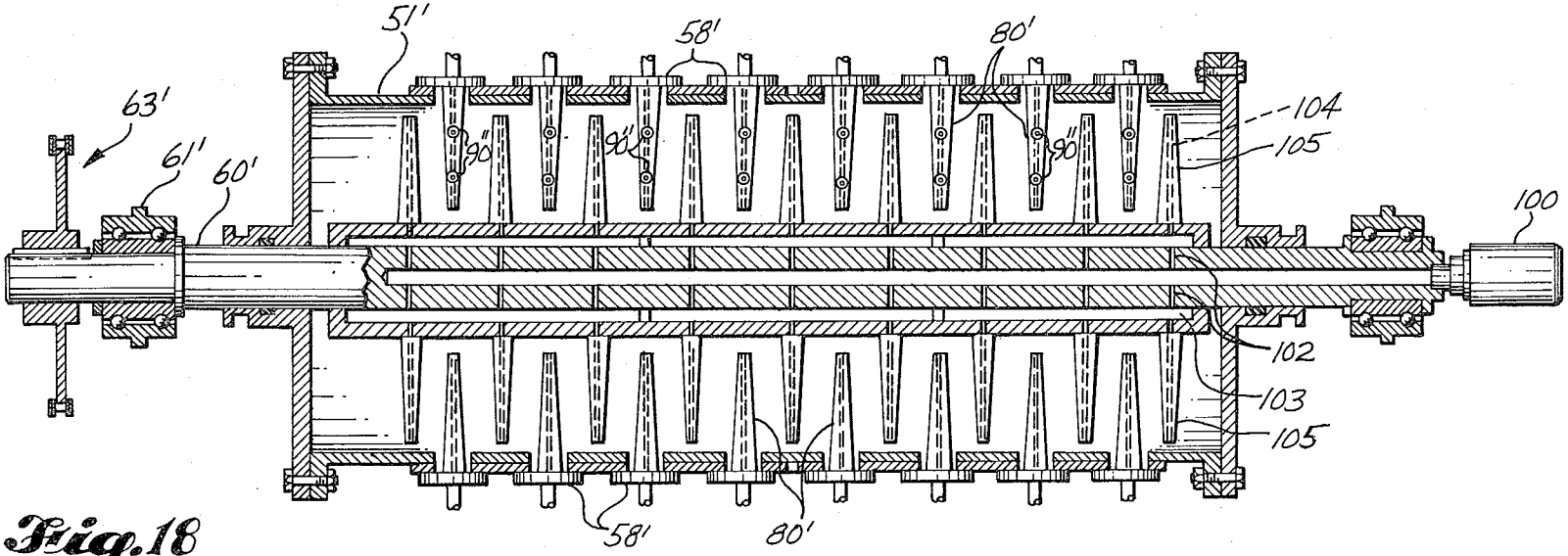
FIG. 18 is a cross section of the mixer taken along line 18—18 of FIG. 17.

The stators admit oxygen to the slurry. The stators are shown in FIGS. 11–13. The stators add oxygen to the pulp in the mixing zone and also act as friction devices to reduce or stop the rotation of the pulp with the rotors so that there is relative rotative movement between the rotors and the pulp. Each stator 80 has a body 81, a central passage 82 and a base plate 83. The stators extend through apertures 56 in body 51. There are two ways of attaching the stators. In FIG. 11, the stator is attached to the body 51 by a friction fit using a Van Stone flange 84. This allows the stator to be rotated if it is desired to change the oxygen placement. In FIG. 12, the base plate 83' is attached directly to the body 51 either by bolts or studs. The oxygen enters the mixer through check valves 90. The stators are round and tapered and the face having the check valves is flattened. The check valves face across a transverse plane of the mixer and in the direction of rotation of the rotors.

Figure 14:
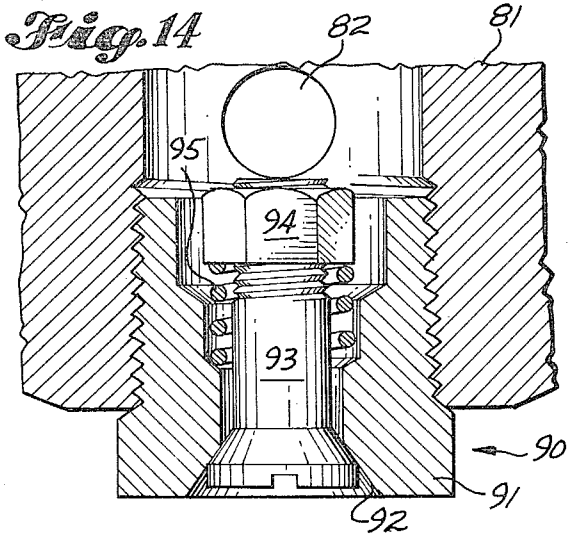
FIG. 14 is a cross section of a valve taken along line 14—14 of FIG. 12.

The purpose of the check valve 90 is to prevent the pulp fibers from entering the passage 82. A typical check valve is shown in FIG. 14. The valve 90 consists of a valve body 91 which is threaded into stator body 81. The valve body has a valve seat 92. The valve itself consists of a bolt 93 and nut 94 which are biased into a closed position by spring 95.

The number of check valves in a stator may vary from 0 to 4. In some mixers, the major portion of the gas would be added at the mixer entrance, requiring up to 4 check valves, and little or no gas would be added near the mixer outlet, requiring 1 check valve or no check valves, and these stators would then only act as friction drag against pulp rotation. For example, between 60 to 70% of the oxygen could be added in the first half of the mixer. The first one third of the stators would have 3 or 4 check valves, the next one third might have 2 check valves, and the last one third might have 1 or no check valves.

The stators may also be arranged in rings. There should be 1 ring of stators for each 1 or 2 rings of rotors. The number of stators in a ring will depend upon the size of the mixer. Usually, there are 4 stators in a ring, but this can normally vary from 2 to 8. The plurality of stators in a ring introduces the chemical throughout a cross section of the pulp slurry, and the plurality of rings introduces the chemical at a number of points throughout the travel of the slurry through the mixer.

Both the rotors and the stators should extend across the annular space. A normal clearance between the rotor and the inner wall of the mixer, or the stator and the outer wall of the central shaft is about 13 mm. This ensures that all of the pulp is contacted by the oxygen and there is no short circuiting of the pulp through the mixer without contact with oxygen. The rotors and stators should be between the inlet and outlet to ensure that all the pulp would pass through the swept area, and would be contacted with oxygen.

FIGS. 15–20 disclose a modification to the basic mixer. Oxygen is carried to the rotors through pipe 100 and passage 101 which extends centrally of shaft 60'. Radial passages 102 carry the oxygen to the outer annular manifold 103. The oxygen passes from the manifold to the pulp through central passage 104 of rotor body 105 and through check valve 90''. These valves are the same as valve 90.

The rotor is shown as round and tapered, but its shape may be different. The rotor may be round or square and nontapered such as those normally found in steam mixers. The round rotors would have radii of curvature exceeding 30 mm. Tapered rotors 106 having a rectangular cross section may also be used.

Figure 21:
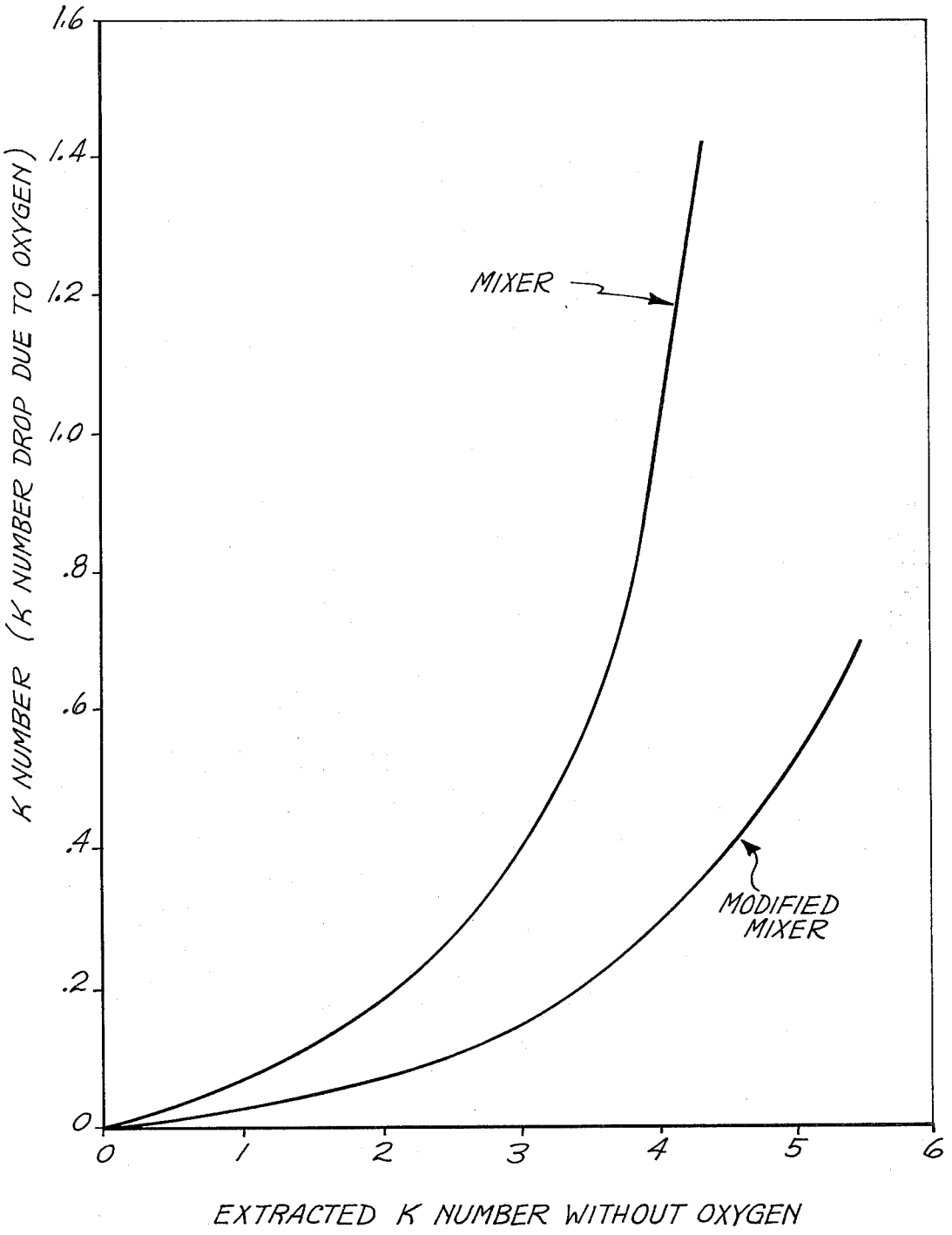
FIG. 21 is a graph comparing two mixers.

FIG. 21 compares the operation of a modified mixer similar to that shown in FIGS. 15–20 with the operation of the mixer of FIGS. 3–14 and indicates the increasing efficiency of the mixer as the swept area is increased and the shaft diameter is expanded. The casing of both mixers was still the same. It had an interior diameter of 0.914 m. The inlet and the outlet where the same. In both, the outer radius of the rotor was the same, 0.444 m. Both processed pulp at the same rate, 810 metric tons of oven-dry pulp per day.

The modified mixer had a speed of rotation of 435 RPM. There were 32 stators in 8 rings and 36 rotors in 9 rings. Each ring of rotors had 2 pegs and 2 blades. The blades were rectangular in cross section. The stators and rotor pegs were round, tapered and 0.254 m long. Oxygen was admitted through the stators only. The diameter of the shaft was 0.38 m and the swept area was 14,100 square meters per metric ton of oven-dry pulp.

The mixer of FIGS. 4–14 had the same internal diameter but had a central shaft that was 0.508 m in diameter. There were 224 rotors. The rotors were elliptical and linearly tapered. The major axis of the rotor extended in the direction of rotation of the rotor. The rotors were 19 cm long. The leading and trailing edges of the rotor had radii of curvature of 3.8 mm. The rotors extended to within about 13 mm of the mixer wall, and the stators extended to within about 13 mm of the central shaft. The speed of rotation was also 435 RPM. The swept area of the mixer was 72,200 square meters per metric ton of pulp. Oxygen was admitted through the stators only.

FIG. 21 compares the extracted K number of the pulp with the additional K number drop after passing through the mixer, and shows that the mixer achieved a greater K number drop than the modified mixer. It was also found that the mixer needed only half the amount of oxygen as in the modified mixer to obtain the same amount of delignification; that is, with the other operating conditions remaining the same, to achieve the same K number drop 11 kilograms of oxygen per metric ton of oven-dry pulp were required in the modified mixer, but only 5 kilograms of oxygen per metric ton of oven-dry pulp were required in the mixer. It was also found that the mixer could mix greater amounts of oxygen with the pulp than the modified mixer. Between 1-½ to 2 times as much oxygen could be mixed with the pulp with the mixer than with the modified mixer. For example, the modified mixer could mix a maximum of 15.1–20.2 kilograms of oxygen with a metric ton of oven-dry pulp. The mixer could mix 30.2–35.3 kilograms of oxygen with a metric ton of oven-dry pulp.

The optimum swept area is achieved by reducing the number of rotors in the mixer from 224 to 203.

FIGS. 22–24 illustrate a different type of rotor and stator arrangement and a different type of oxygen admission.

In this modification, an oxygen manifold 98 surrounds the outer body 51'' of the mixer and the gas enters the mixer through holes 99 in body 51''. An annular dam 107, located between each ring of holes 99, is attached to the inner wall of body 51''. The dams 107 create a pool of gas adjacent the mixer wall. The stators 85 are attached to the dams 107. The rotors 75 are aligned with the spaces between the dams 107. The outer radius of the rotors 75 is greater than the inner radius of the dams 107 so that the rotors extend beyond the inner wall 108 of the dams into the trapped gas between the dams. This construction allows the rotor to extend into a gas pocket and for the gas to flow down the trailing edge of the rotor as it passes through the pulp slurry.

The rotors and stators may be flat with rounded leading and trailing edges. Again, the radius of curvature of the leading and trailing edges would be in the range of 0.5 to 15 mm, and the radii need not be the same. The rotors or stators may be as narrow as 6.35 mm in width.

This design could also include the groove in the trailing edge of the rotor which may be covered with a hydrophobic coating.

These mixers should operate with a back pressure. This pressure may be provided by an upflow line which creates a hydrostatic head at the mixer. A pressure valve is preferred. The valve may be used alone or in combination with an upflow line. The valve would be placed in the outlet line from the mixer either right after the mixer or in or at the top of the upflow line. The maximum pressure in the mixer would normally not exceed 830 kPa gage, and the pressure at the top of the pipe would normally not exceed 345 kPa gage.

The mixer has also been tested under a hydrostatic pressure only.

It also may be helpful in the understanding of the mixer to describe a typical pulp mill and relate the mixer to this typical mill.

Figure 25A:
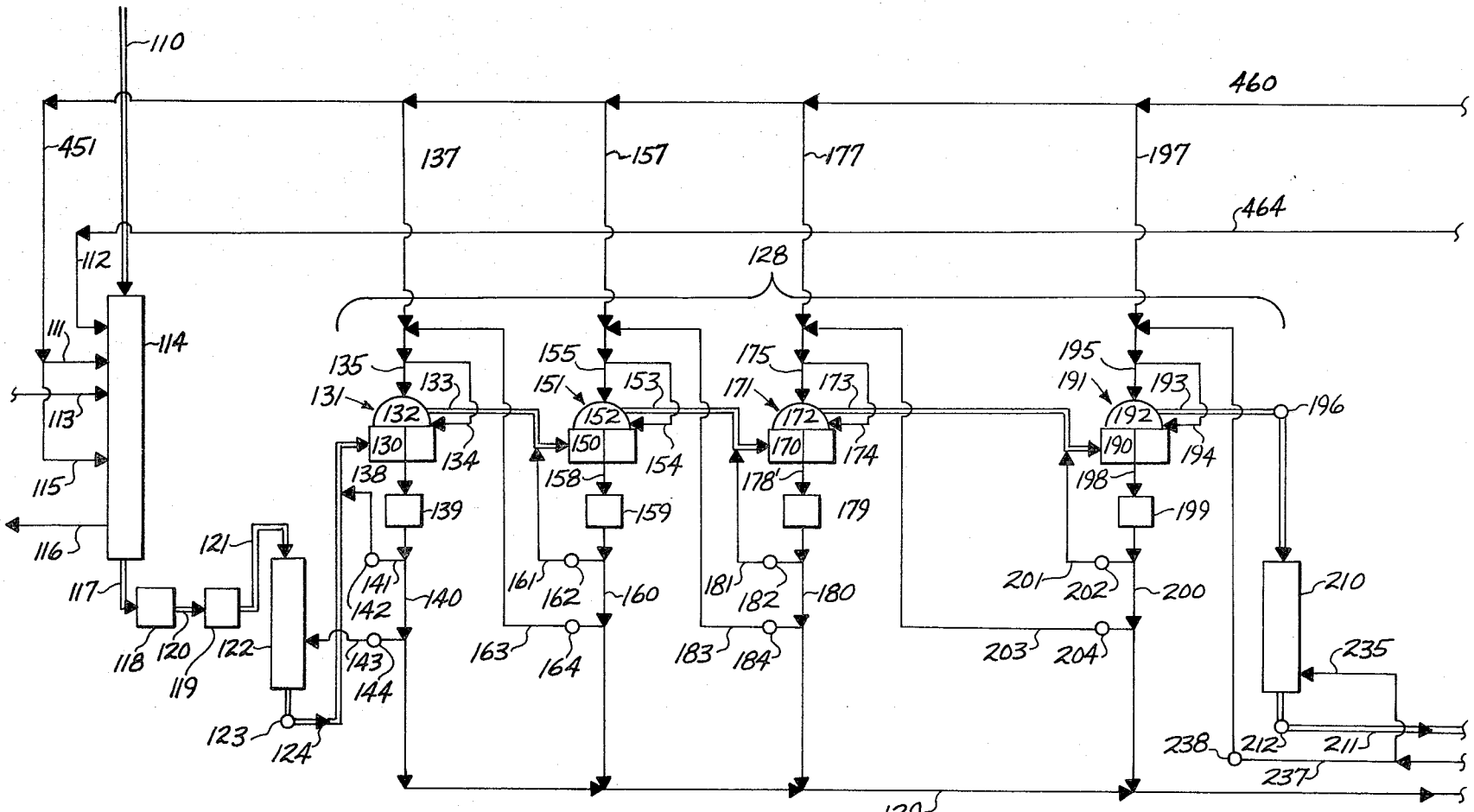
Fig. 25A PRIOR ART
FIGS. 25 (A-C) is a diagram of a prior art pulping and bleaching process.
Figure 25B:
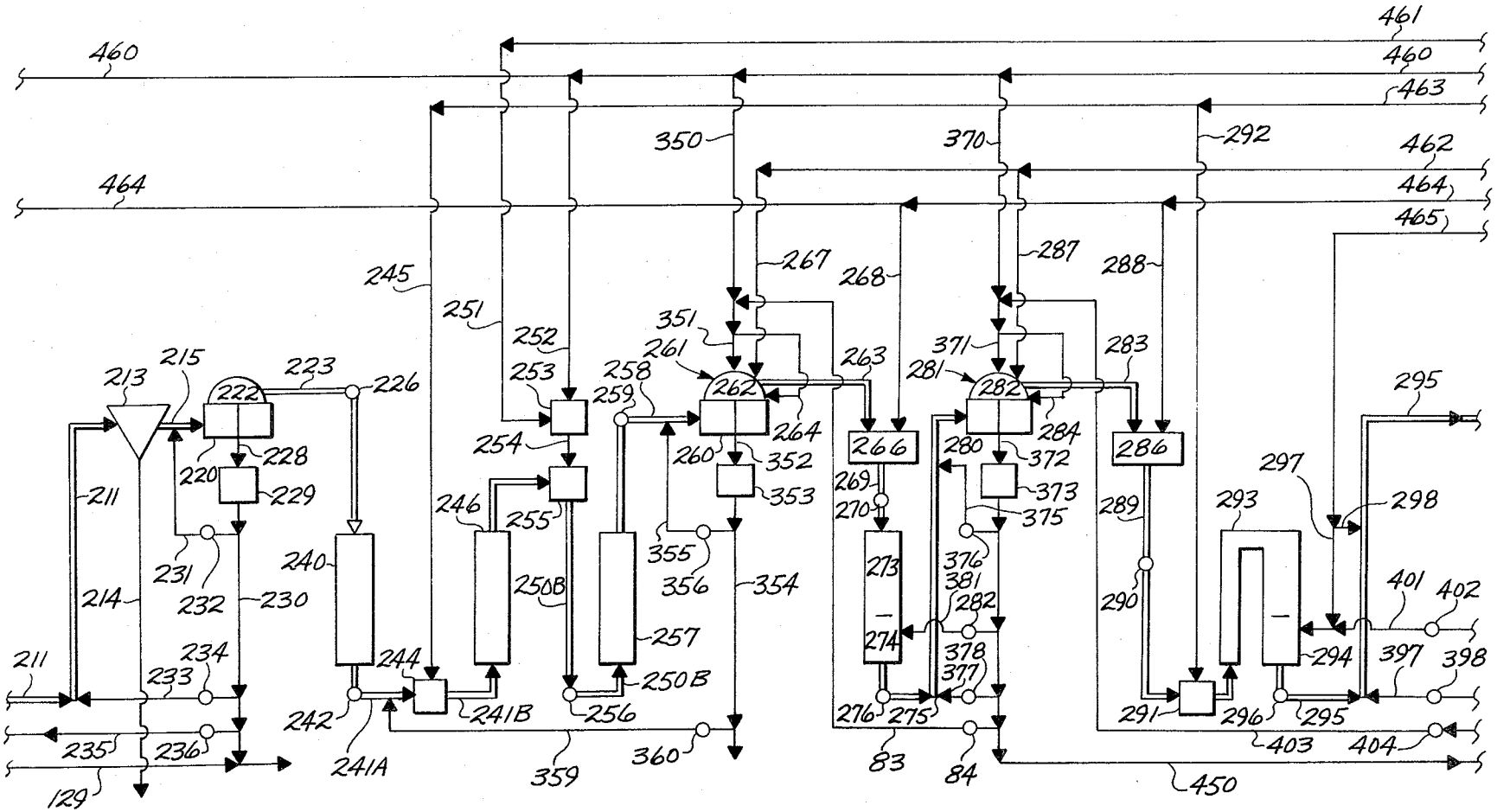
Fig. 25B PRIOR ART
Figure 25C:
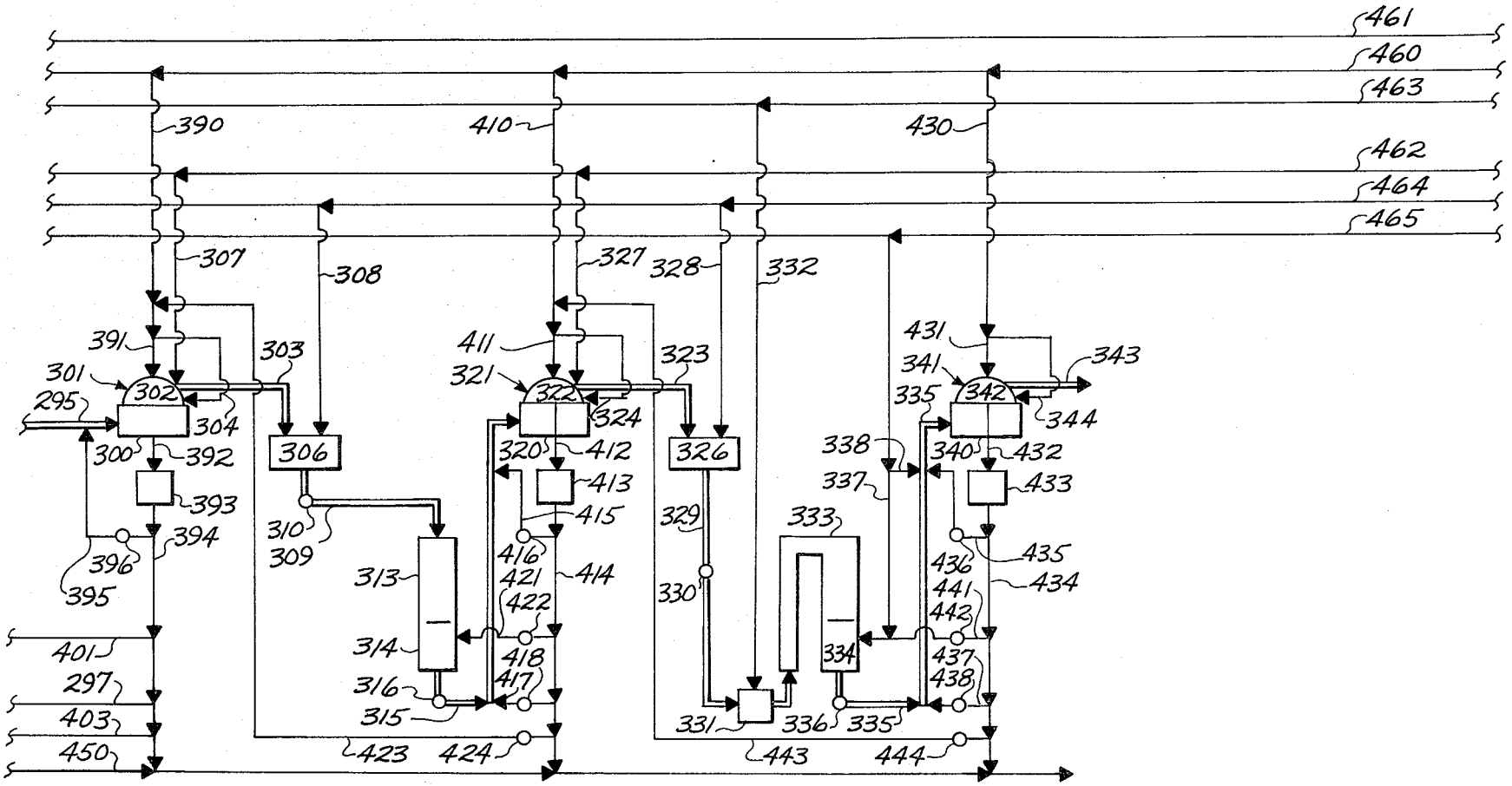
Fig. 25C PRIOR ART

FIGS. 25A–25C is a diagram of a typical pulp mill. In the mill the means of transporting chips or pulp from one operation to another will depend upon the consistency of the pulp and the location of the equipment. The transportation means may be a conveyor or a chute if the consistency is too high for the pulp or chips to be pumped, or a pipe if the pulp is capable of being pumped.

Chips 110, process water 111, steam 112 and pulping chemicals 113 are placed in a digester 114. The wood chips 110 may be treated prior to entering the digester 114. This is optional. Exemplary of such treatment are presteaming of the chips in a steaming vessel or impregnation of the chips with the digestion chemicals in an impregnation vessel prior to entering the digester. The chemicals 113 will depend on the process being used, be it sulfate, sulfite, or soda, and the digester 114 may either be batch or continuous in operation. A continuous digester is shown. The chips will be cooked under appropriate conditions within the digester. These conditions, which depend on the species of chip and the type of pulping used, are well known.

The products of the digestion process are the delignified or partially delignified wood chips, the spent pulping chemicals, and the lignin and carbohydrate products which have been removed from the wood chips in the digestion process. The treatment of the chips, after cooking, will depend in part on the type of digester being used. A major portion of the spent pulping chemicals and lignin products are removed from the chips prior to further processing. In the continuous digester shown, the chips are washed in the washing section of the digester. This is indicated by process water 115 entering and effluent stream 116 leaving the washing stage of digester 114. The effluent 116 will consist of the lignin and carbohydrates which have been removed from the chips during the digestion process and the spent digestion chemicals. This effluent will be carried to a treating facility. In the case of kraft or sulfate pulp this would be a recovery system in which the liquor is burned to recover the digestion chemicals for reuse.

This washing would not take place in a batch digester. In a batch system, all the washing would occur in the following brownstock washing system.

Following this treatment, the chips will pass from the digester 114 through the blow line to storage or blow tank 122. It is customary in pulp mills to have storage tanks between separate processes so that the entire mill will not shut down if one section of the mill is shut down. Storage tank 122 is one such tank. It would be between the digester stage and the subsequent washing or bleaching stages. The storage tank 122 is open to the atmosphere and so is at atmospheric pressure.

Tank 122 may also be a diffusion washer instead of a storage tank. Diffusion washers are described in Rydholm *Pulping Processes* Interscience Publishers, 1965 pages 725–730 and illustrated in FIG. 10.14 on page 728. The diffusion washer would be followed by a storage tank.

The material passing through the blow line is a slurry which contains the remaining lignin and carbohydrates, the spent digestion chemicals, and the fibers formed from the chips as they are blown from the digester. The chips will be formed into fibers when the pressure on the chips is partially released, usually at the exit of digester 114. The slurry will still be under some pressure to move it through the blow line. If the digester is continuous, then additional fiberizing may be done by a refiner, or refiners, in the blow line. The refiners will fiberize the large particles that have not been reduced to fibers earlier in the process. In the present diagram, two refiners—118 and 119—are shown. In the two-refiner system, the first refiner 118 does course refining and the second refiner 119 does fine refining. The refiners are optional. They are usually encountered in a linerboard mill. The digester in a bleached pulp mill normally would not have refiners in the blow line. Neither would they be used with a batch digester.

The blow line is shown in three sections—section 117 between the digester 114 and refiner 118; section 120 between the refiners 118 and 119; and section 121 between the refiner 119 and the tank 122.

From the storage tank 122 the fibers and liquor are carried by pulp 123 through line 124 to the washers and screens. The system will be described by following the pulp through the system, and then following the wash water through the system.

The pulp slurry is first carried to the brownstock washers 128 where the rest of the lignin and chemicals are removed from the fibers. Four washers are shown. This is the number that would normally be used with a batch digester. The washing section in a continuous digester would replace the first two brownstock washers. Each of these washers is usually a vacuum or pressure drum washer or vacuum or pressure drum filter and the operation of each would be the same. Some of the washers may be diffusion washers. If diffusion washers are used, the slurry would not be diluted to 1-½ to 3-½% consistency prior to entering the washers.

The pulp slurry from line 124 enters the vat 130 of washer 131. The vacuum drum 132 revolves through the vat, and the vacuum pulls the fibers in the slurry onto the outer surface of the filter drum and holds the fibers, in mat form, against the surface while pulling the liquor or filtrate through the filter cloth to the interior piping of the vacuum drum to be discharged as effluent. The revolving drum carries the fiber mat from the vat past a bank of washer heads that spray a weak filtrate onto the mat to displace the liquor from the mat. The vacuum also pulls this displaced liquid into the interior piping of the drum.

The pulp mat 133 is removed from the face of the drum 132 by a doctor blade, carrier wires or strings between the drum and the mat, rolls or any other standard manner and carried to the vat 150 of the second brownstock washer 151. Again, the fibers are picked up on vacuum drum 152. The pulp mat 153 is washed with still weaker filtrate, removed from the vacuum drum 152 and carried to the vat 170 of brownstock washer 171. The operation of this washer is the same as the others, the vacuum drum being 172 and the mat 173. The mat 173 is carried to the vat 190 of the last brownstock washer 191. Again, the operation of this washer is the same as the others, the vacuum drum being 192 and the mat 193.

From the brownstock washers the pulp mat 193 is carried to storage tank 210 with the aid of thick stock pump 196. In the lower section of tank 210, the pulp is diluted and then carried through line 211 by pump 212 to screens 213 in which the larger fiber bundles and knots are removed. The bundles and knots 214 are carried to further treatment by suitable transporter means.

The pulp 215 is carried from the screens 213 to the vat 220 of decker 221 in which additional water is removed. The operation of the decker is similar to that of the washers. Washing showers may or may not be used on the decker. The vacuum drum is 222 and the pulp mat is 223. The pulp 223 is carried by thick stock pump 226 to a high-density storage tank 240 in which it is stored until it is bleached.

The liquor or filtrate from the vat 220 and the mat 223 flows through piping which extends radially from the vacuum chambers at the surface of the vacuum drum 222 to a pipe in the central shaft of the rotating drum. This liquor or filtrate passes through the central pipe and an external line 228 to a filtrate storage tank or seal tank 229. The tank 229 is both a storage tank and a seal tank because it acts both to store the filtrate for further use and to seal the vacuum drum 222 from the outside atmosphere to maintain the lower pressure of the vacuum system within the drum.

The filtrate from tank 229 may be handled in several ways. Several of the uses may occur simultaneously. Although the following description is specific to the effluent from tank 229, it is also illustrative of how the effluent from any of the washers in brownstock washing system 128 would be handled.

First, the filtrate from tank 229 is reused to reduce the consistency of the pulp slurry either entering the decker 221, entering the screens 213 or leaving storage tank 210. Line 230 carries the filtrate to lines 231, 233 and 235. Line 231 and pump 232 carry the filtrate back to screened pulp 215 to reduce the consistency of the pulp slurry entering vat 220 to around 1-½%. Line 233 and pump 234 carry the filtrate back to line 211 to reduce the consistency of the pulp slurry entering the screens 213 to from 0.2 to 2%. Line 235 and pump 236 carry the filtrate back to storage tank 210 to reduce the consistency of the pulp slurry leaving the tank to around 5%.

Second, the filtrate not reused for dilution may be taken to an effluent treatment system by line 230 and effluent line 129. This treatment may include combining the effluent with the effluent in line 116, or carrying the effluent directly to the cooking liquor recovery system. It should be understood that in a batch digester system the digester effluent is recovered completely from the brownstock washing system while in a continuous digestion system only a portion of the digester effluent would be recovered from the brownstock washers.

All of the remaining filtrate would be handled as effluent if counterflow washing, to be described next, is not used. Some of the filtrate may be handled as effluent even if counterflow washing is used.

Third, the filtrate from tank 229 may be used as wash water in the brownstock washing system 128 in a counterflow washing system. In this system, the filtrate flow is counter to the flow of pulp. The line 237 and pump 238 carry the filtrate back to brownstock washer 191 for use as wash water. The filtrate is sprayed on the pulp mat by washer heads 195 and displaces the liquor within the mat. This filtrate may also be sprayed on the carrier wires, strings or rolls after the pulp mat is separated from them to remove any pulp fibers that cling to the wires, strings or rolls if water instead of air is used for this operation. This is done by cleanup washer 194. Additional water may be required to supplement the filtrate. This is provided through process water line 197.

The flow of filtrate through brownstock washer 191 is the same as the flow through decker 221. The liquor, either from the mat or the vat, is carried through internal piping to line 198 and through line 198 to filtrate storage tank or seal tank 199. Again, the filtrate from the seal tank 199 may be handled in a number of ways. Line 200 would carry it to effluent line 129. Line 201 and pump 202 would carry the filtrate to pulp 173 to reduce the consistency of the pulp slurry to 1-½ to 3-½% as it enters vat 190. Line 203 and pump 204 would carry the filtrate to brownstock washer 171 to be used as wash water.

The process in brownstock washers 171, 151 and 131 are, for the most part, identical to the process in brownstock washer 191 so the parts are similarly numbered. The washer heads are 175, 155 and 135 respectively. The cleanup washers are 174, 154 and 134 respectively. The filtrate lines are 178, 158 and 138 and the filtrate storage or seal tanks are 179, 159 and 139. The filtrate lines from the seal tanks to effluent line 129 and 180, 160 and 140.

The consistency of the slurry entering any of the vats 170, 150 or 130 should be 1-½ to 3-½%. The lines and pumps carrying the filtrate to the pulp to reduce the consistency of the slurry entering a vat are 181 and 182, 161 and 162, and 141 and 142, respectively. The counterflow wash water lines and pumps are 183 and 184, and 163 and 164.

In brownstock washer 131, line 143 and pump 144 carry the filtrate into storage tank 122 to reduce the consistency of the pulp slurry in the bottom of the tank to 2 to 3-½% before it exits the tank.

In each of the brownstock washers, there is a possibility that additional process water may be needed to supplement the filtrate being used as wash water. Lines 177, 157 and 137 are for this purpose. These lines would provide all the wash water to the individual washers if the counterflow system described above is not used and parallel flow washing is used instead.

The washed pulp which has passed through the brownstock washing system 128, the screens 213 and decker 221 remains in storage tank 240 until it is carried into the bleaching system.

The bleaching process in FIG. 1 will also be described by following the pulp stream through the bleaching system from washed pulp to bleached pulp and then by following the wash water from its entry into the process through to bleach plant effluent. The particular bleaching sequence illustrated is $D_c$EDED. The process conditions are taken from the TAPPI monograph *The Bleaching of Pulp* noted earlier.

There are many other bleaching sequences which could be used. Listings of these sequences may be found in the standard texts. As a rule, the first stage is chlorine and subsequent stages use chlorine dioxide, hydrogen peroxide, or a hypochlorite. These stages are interspersed with alkali extraction stages.

The pulp stored in high-density tank 240 normally is at a consistency of approximately 9 to 15%. This pulp slurry is carried from tank 240 through line 241 to tank 246 by pump 242. The pulp in line 241 is diluted with additional water or filtrate to a consistency of around 5%. In mixer 244 in line 241, the slurry is mixed with chlorine dioxide from line 245 as the D step of the first stage $D_c$ bleach. If the first stage is to be chlorine alone, then this step would be omitted. The treated dilute slurry enters storage tank 246 in which the chlorine dioxide reacts with the unbleached pulp. The size of this tank will depend upon the amount of pulp being treated and the time of the chlorine dioxide treatment. The time of this initial treatment normally is one to five minutes. The slurry exits the tank into line 250 and is treated with chlorine.

Chlorine from line 251 and process water from line 252 are mixed in aspirator 253 and the diluted chlorine flows through line 254 to mixer 255 in which the chlorine is mixed with the dilute pulp slurry in line 250. The treated slurry is moved by pump 256 through line 250B into chlorine bleaching tower 257. The tower 257 is sized to allow the chlorine to react with the extraneous matter in the unbleached pulp. This retention or reaction time will depend, in part, on the water temperature. At minimum temperature, the TAPPI monograph suggests a retention time of about 45 to 60 minutes for sulfite pulp, and 60 to 90 minutes for kraft pulps. The treated slurry exits tank 257 and is carried through line 258 by pump 259.

The slurry in line 258 is combined with additional water or filtrate to reduce the consistency to about 1 to 1-½%. This dilute slurry flows into vat 260 of washer 261. Again a vacuum drum washer or filter is shown. The operation of this washer is the same as that of the brownstock washers. The vacuum drum 262 revolves through the vat. The vacuum pulls the fibers in the slurry onto the outer filter surface of the drum and holds them against the surface, forming a mat, while pulling the liquid or filtrate through the filter cloth to the interior piping of the vacuum system in the drum to be discharged as effluent. The revolving drum 262 carries the fiber mat from the vat past a bank of washer heads which spray water or weak filtrate onto the mat to displace reaction products and unreacted chlorine entrained in the mat.

The pulp mat 263 is removed from the face of drum 262. The means of removal is the same as in the brown-stock washers—a doctor blade, carrier wires or strings between the drum and the mat, rolls or in any other standard manner. The pulp mat 263 is moved to mixer 266. This movement usually is by gravity fall through a chute from the washer to the mixer.

Prior to leaving washer 261, the pulp mat 263 is impregnated with the caustic or alkali extraction solution from line 267. A sodium hydroxide solution is usually used. The alkali solution is applied to the mat just as it is leaving the vacuum drum 262 so that the solution will penetrate the pulp mat but not be carried through the mat into the washer effluent. The amount of alkali added, expressed as sodium hydroxide, will be 0.5 to 7% of the oven-dry weight of the pulp. The sodium hydroxide may be added to the pulp in the steam mixer 266 instead of at the washer 261.

In steam mixer 266 the treated mat is mixed with steam from line 268 to raise the temperature of the pulp to approximately 62° C. The heated slurry is carried through line 269 into extraction tower 273 by high-density pump 270. In some cases transfer to the extraction tower is by gravity. The extraction tower may be downflow or upflow. The high-density pump 270 for either an upflow or a downflow tower may be at the base of the tower. The pulp would then be carried to the top of a downflow tower by an external line. The location of the pump in the plant is a matter of convenience. Support of the pump and access to the pump for maintenance are primary considerations. The slurry remains in tower 273 to allow the extraction solution to react with and extract the chlorinated materials from the pulp. This time may be one to two hours.

Before leaving the extraction tower, the pulp slurry is mixed with water or filtrate in dilution zone 274 to reduce its consistency to approximately 5%. The slurry is carried by line 275 and pump 276 from dilution zone 274 to the vat 280 of washer 281. During its passage through line 275, it is further diluted with water or filtrate until its consistency is approximately 1 to 1-½% when it reaches the vat 280. The operation of washer 281 is identical to that of washer 261. The fibers are picked up on the revolving drum 282, washed and removed as pulp mat 283.

The pulp is then moved to steam mixer 286 of the chlorine dioxide stage. This transfer may again be by gravity drop through a chute. Prior to leaving washer 281, the mat 283 is treated with a slight amount of alkali from line 287. A sodium hydroxide solution is usually used. It is added to the mat at a point on the drum which will allow the solution to stay in the mat and not pass into the filtrate. The purpose of this treatment is not further extraction but adjustment of the pH of the pulp prior to being treated with chlorine dioxide. The pH of the pulp should be in the range of 5 to 7, preferably 6, for optimum brightness when bleaching with chlorine dioxide. The alkali may be added in the steam mixer 286 instead of the washer 281.

In steam mixer 286 of pulp 283 is mixed with steam from line 288. The pulp will have a consistency of approximately 1% less than from the washer when it leaves a steam mixer.

The pulp leaves steam mixer 286 and is carried through line 289 by pump 290 to mixer 291 in which it is combined with chlorine dioxide from line 292. It then enters chlorine dioxide tower 293. This tower usually is an upflow-downflow tower. The pulp remains in the tower long enough to allow the chlorine dioxide to react with it. The reaction is about complete after one hour but normally continues for up to four hours. Consequently, the retention time in the tower is usually four hours. Prior to leaving the tower, the slurry is diluted to a consistency of about 5% in dilution zone 294. It is also treated with a small amount of sulfur dioxide or alkali from line 297. The sulfur dioxide or alkali reacts with any excess chlorine dioxide so there will be no free chlorine dioxide emanating from the washer or the pulp leaving the washer.

This diluted slurry is then carried by line 295 and pump 296 to vat 300 of washer 301. During its passage through line 295, the slurry is again diluted so that it is at a consistency of about 1 to 1-½% when it reaches vat 300, and again treated with additional sulfur dioxide from line 298. The pulp is picked up on vacuum drum 302, and the reaction products and unreacted bleaching chemicals washed from it prior to being removed as pulp mat 303.

This pulp is moved to the steam mixer 306 of the second extraction stage, usually by gravity drop through a chute. Again, sodium hydroxide from line 307 is added on washer 301 or at the mixer 306, and in mixer 306 the treated pulp mat 303 is mixed with steam from line 308. This slurry is then carried through line 309 by pump 310 to extraction tower 313. The conditions in this extraction stage are the same as those in the first extraction stage. The tower may be downflow or upflow.

After the appropriate dwell time, the pulp enters dilution zone 314, and its consistency is reduced to approximately 5%. The pulp is then carried through line 315 by pump 316 to the vat 320 of washer 321. Again, it is diluted to a consistency of about 1 to 1-½% before entering the vat. The slurry is picked up by vacuum drum 322 and washed and discharged as pulp mat 323. If necessary, the pH of the pulp may be adjusted by treating the mat with sodium hydroxide from line 327. This may occur on the drum 322 or in the steam mixer 326.

The pulp enters the last chlorine dioxide stage. The conditions and flow in this stage are the same as in the first chlorine dioxide stage. The pulp is dropped into or carried to steam mixer 326, and mixed with steam from line 328. The slurry is carried through line 329 by pump 330 to mixer 331, mixed with chlorine dioxide from line 332 and carried into the chlorine dioxide tower 333, shown as an upflow-downflow tower, where it remains for one to four hours. The pulp then enters dilution zone 334 where its consistency is reduced to about 5%. It is also treated with a small amount of sulfur dioxide from line 337 to remove any excess chlorine dioxide.

The slurry is carried from dilution zone 334 through line 335 by pump 336. During its travel through line 335, the pulp is again treated with additional sulfur dioxide from line 338 to remove any free chlorine dioxide and is further diluted so that the slurry is at a consistency of about 1 to 1½% when it reaches vat 340 of washer 341. It is picked up by vaccum drum 342, washed and discharged from the bleaching system as bleached pulp 343.

Pulp from the mat usually adheres to the wire or strings carrying the pulp mat from the washer and it is necessary to wash these fibers from the wires or strings into the vat prior to their contacting new fibers. This may be done by cleanup washer 264 on washer 261, cleanup washer 284 on washer 281, cleanup washer 304 on washer 301, cleanup washer 324 on washer 321, and cleanup washer 344 on washer 341. Air may also be used.

The passage of liquid through the washer is the same as in the brownstock washers. Wash water is sprayed onto the mat by the washer heads. This water displaces the entrained liquid within the pulp mat on the drum. The displaced liquid is carried through piping internally of the rotating vacuum drum to a pipe in the central shaft of the drum. Here, it is combined with the liquor being pulled into the drum from the washer vat. This combined liquor passes outwardly through a central pipe in the drum and an external line to a seal or storage tank which maintains the vaccum in the drum by providing a seal between the vacuum inside the drum and the ambient pressure externally of the drum.

In washer 261, the washer heads are 351, the external line is 352 and the seal or storage tank is 353. In washer 281, the washer heads are 371, the external line is 372 and the seal or storage tank is 373. In washer 301, the washer heads are 391, the external line is 392, and the seal or storage tank is 393. In washer 321, the washer heads are 411, the external line is 412, and the seal or storage tank is 413, and in washer 341 the washer heads are 431, the external line is 432, and the seal or storage tank is 433.

The routes taken by the filtrate after it leaves the seal or storage tank are also the same as those in the brownstock washers.

First, the filtrate is used to dilute the slurry within the washing stage or a tower.

For example, the filtrate would dilute the pulp slurry being carried to the vat. The filtrate from the seal tank 353 of the chlorine stage washer 261 would be carried by line 355 and pump 356 into line 258 to be used to dilute the pulp slurry going to vat 260. In the same way, line 375 and pump 376, and line 377 and pump 378, carry the filtrate from the seal tank 373 of the first extraction stage washer 281 into line 275 to dilute the slurry going to vat 280; line 395 and pump 396, and line 397 and pump 398, carry the filtrate from the seal tank 393 of the first chlorine dioxide stage washer 301 into line 295 to dilute the slurry going to vat 300; line 415 and pump 416, and line 417 and pump 418, carry the filtrate from the seal tank 413 of the second extraction stage washer 321 into line 315 to dilute the slurry going to vat 320; and line 435 and pump 436, and line 437 and pump 438, carry the filtrate from the seal tank 433 of the second chlorine dioxide washer 341 into line 335 to dilute the slurry going to vat 340.

In the chlorine stage, line 359 and pump 360 also carry the filtrate to line 241 to dilute the pulp from high-density storage.

In the extraction and chlorine dioxide stages, the filtrate is also supplied to dilute the slurry in the dilution zone of the tower in the stage. In the first extraction stage, the filtrate from seal tank 373 is carried into the dilution zone 274 by line 381 and pump 382. In the first chlorine dioxide stage, line 401 and pump 402 carry the filtrate from the seal tank 393 into the dilution zone 294. In the second extraction stage, line 421 and pump 422 carry the filtrate from the seal tank 413 into dilution zone 314, and in the second chlorine dioxide stage 441 and pump 442 carry the effluent from the seal tank 433 into dilution zone 334.

Second, the filtrate not reused for dilution is discharged as effluent or to further processing as by line 354 from tank 353, line 374 from tank 373, line 394 from tank 393, line 414 from tank 413, and line 434 from tank 433. The effluent from the chlorine stage washer 261 is separate from the effluent from the other washers because of its high chlorine or salt content and its larger content of residual material. The other lines—374, 394, 414 and 424—discharge into effluent line 450.

All of the remaining filtrate would be handled as effluent if counterflow washing is not used. Some of the filtrate may be handled as effluent even if counterflow washing is used.

In the counterflow washing system shown, the wash water for the second chlorine dioxide washer 341 is process water from line 430; the wash water for the second extraction washer 321 is partly or wholly filtrate from the second chlorine dioxide washer 341 which is supplied from seal tank 433 by line 443 and pump 444; the wash water for the first chlorine dioxide washer 301 is partly or wholly filtrate from the second extraction washer 321 which is supplied from seal tank 413 by line 423 and pump 424; the wash water for the first extraction washer 281 is partly or wholly filtrate from the first chlorine dioxide washer 301 which is supplied from seal tank 393 by line 403 and pump 404; and the wash water for the chlorine washer 261 is partly or wholly filtrate from the first extraction washer 281 which is supplied from seal tank 373 by line 383 and pump 384. Any additional wash water would be supplied through lines 350, 370, 390 and 410. These lines would provide all the wash water to the individual washers if the counterflow system is not used and parallel flow washing is used instead.

The chemical, water and steam supplies to the system are shown in the upper section of FIG. 25. Process water is carried through line 460 to the various lines supplying water to the process, line 451 to the digester lines 111 and 115, lines 137, 157, 177 and 197 to the brownstock washers 128, line 252 to the chlorine aspirator 253, and lines 350, 370, 390, 410 and 430 to the bleach system washers. Chlorine is supplied through line 461 to line 251. Alkali line 462 supplies dilute alkali to lines 267, 287, 307 and 327. It is normally a 5–10% solution before entering line 462. Chlorine dioxide line 463 supplies a chlorine dioxide solution to lines 245, 292 and 332. Steam is supplied through line 464 to steam lines 112, 268, 288, 308 and 328. Sulfur dioxide is supplied to lines 297, 298, 337 and 338 from line 465.

The bleach washers 261, 281, 301, 321 and 341 may also be diffusion washers. The slurry would not be diluted to 1 to 1½% consistency before entering a diffusion washer.

Figure 26:
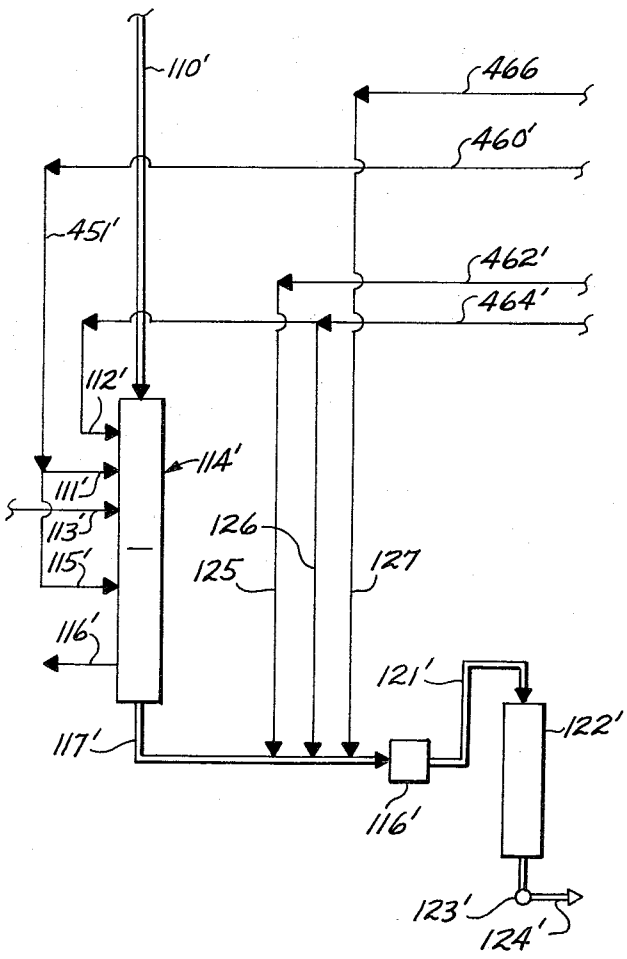
FIG. 26 is a diagram showing the mixer used in a blow line.

FIG. 26 illustrates the use of the mixer in the blow line of the digester. The system shown treats the pulp with oxygen.

In this figure, the reference numerals are identical to those found in FIG. 25, 110' being the incoming chips, 111' being the process water, 112' being steam, 113' being the pulping chemicals, and 114' being the continuous digester. Again, the chips 110' may be treated prior to entering the digester 114' by presteaming or impregnation with digestion chemicals or any other type of treatment. Again, any type of pulping process may be used, and the pulping conditions for a particular process will depend upon the species of wood chip and the product desired. The pulping conditions and the amounts of chemical are well known.

The digester 114' would be continuous in this example because a major portion of the delignification products should be removed prior to the oxygen treatment and the washing stage of the continuous digester provides this washing. Reference numerals 115' and 116' refer respectively to the wash water entering and the effluent leaving the washing stage of the continuous digester.

In FIG. 26 the refiners have been omitted so only the section of the blow line are shown 117' and 121'. The mixer, shown in the blow line between the blow line sections 117' and 121', is indicated by reference numeral 116.

As in FIG. 25, reference numeral 122' is the storage tank or diffusion washer, 123' is the pump and 124' is the line carrying pump from the tank 122' to further processing.

The purpose of the present invention is to treat the washed pulp with a chemical, in this case oxygen, with as little change to the equipment as possible. Sodium hydroxide, and steam are added to the pulp slurry in line 117' before mixer 116. Sodium hydroxide, which both adjusts the pH of the pulp and buffers the oxygen reaction, is added through line 125. Other suitable alkalies, such as white liquor, may also be used. Steam is added through line 126. The steam raises the temperature of the pulp to a temperature appropriate for the oxygenation. Oxygen is added to the pulp through line 127. The oxygen would be added to the slurry in the mixer 116 as described earlier.

The lines used to carry these various chemicals to the process are shown in the upper section of FIG. 26. Line 460' carries process water to lines 111' and 115'. Line 462' carries sodium hydroxide to line 125. Line 464' carries steam to lines 112' and 126. Line 466 carries oxygen to line 127. In some instances, the alkali is used both as a digestion chemical and for the oxygen treatment, as in the soda process in which sodium hydroxide is used for both digestion and oxygen treatment, or the kraft process in which white liquor is used for both digestion and oxygen treatment. In this case, line 462' would also supply line 113'.

A back pressure on the mixer 116 would be provided by either an upflow leg in line 121', a pressure valve in line 121' or combination of the upflow leg and the pressure valve as described earlier.

Much of the treatment would occur in the mixer and a majority in the mixer through to the back pressure valve or top of the pipe in the mixer outlet line.

The amount of oxygen used will depend upon the yield and K or Kappa number of the pulp to be treated, and the desired result of the treatment. Between 5 to 50 kilograms of oxygen per metric ton of oven-dry unbleached wood pulp is required for the oxygen treatment.

In a low yield, low Kappa number pulp the purpose of oxygen treatment would normally be bleaching. The actual yield and Kappa number would depend on the pulping process used, but these pulps are used for bleached products. The blow line and brownstock Kappa number for pulp being used in bleached products is usually around 30 to around 40. The amount of oxygen used to bleach the pulp would be between 5 and 40 kilograms per metric ton of oven-dry pulp.

In a high yield, high Kappa number pulp of the type usually used for linerboard for the purpose of the oxygen treatment is to provide certain properties of the product. The blow line and brownstock Kappa number for this pulp is usually around 80 to around 120. This allows the mill either to increase certain property values of the product at the same pulp yield or to maintain the property value while increasing the yield. As an example, the application of 12 to 50 kilograms of oxygen to a high yield, high Kappa number pulp will either increase the ring crush of a liner prepared from the pulp or maintain the ring crush at the same value and increase the yield. Ring crush is determined by TAPPI Standard T 818 OC-76.

Other conditions may need adjustment for oxygen treatment. The pH for any oxygen treatment in any environment should be between 8 and 14. The amount of alkali, expressed as sodium hydroxide, would be between 0.25 to 8% of the oven-dry weight of the unbleached wood pulp. The temperature for any oxygen treatment in any environment is usually between around 65° C. to around 121° C. The actual temperature, however, in any oxygen stage will depend upon the ability to heat the pulp so it may vary from around 65° C. to around 121° C. depending on the location of the oxygen stage in the system.

To determine the ability of oxygen to change the properties of pulp, a pulp having a Kappa number of 120 and a yield of 58.6 was treated with oxygen in pilot plant equipment. The equivalent of 20 kilograms of oxygen per metric ton of oven-dry pulp was applied to the pulp. The temperature was 90° C. Sodium hydroxide addition was 4% of the weight of the oven-dry pulp. No protector, such as magnesium oxide, was added. In fact, no protector was used in any of the experiments described in this application.

The treated pulp had a Kappa number of about 65. It was compared to a kraft pulp having a 58 Kappa number. The tests were at 675 Canadian Standard Freeness. The oxygen treated pulp had a ring crush 15% greater than the kraft pulp and a burst 2% greater than the kraft pulp. Canadian Standard Freeness is determined by TAPPI Standard T 227 M-59, revised August 1958, Burst is determined by TAPPI Standard Test T 220 M-60, the 1960 Revised Tentative Standard.

Again the actual chemical application will depend upon the starting pulp and whether it is desired to increase properties or yield. The oxygen application may be from 12 to 50 kilograms per metric ton of oven-dry pulp. The alkali addition, expressed as sodium hydroxide, would normally be from 3.6 to 4.9% and the temperature would normally be from 82° to 95° C. A slight amount of protector might be used. This would not exceed 0.5% based on the weight of the oven-dry pulp.

The final product would have a Kappa number ranging from 65 to 69; a ring crush, compared to a kraft pulp, of from 3% less when yield is increased to 28% more if better properties are desired; and a burst, compared to kraft pulp, of the same number if yield is increased to 6% greater if better properties are desired.

Figure 27:
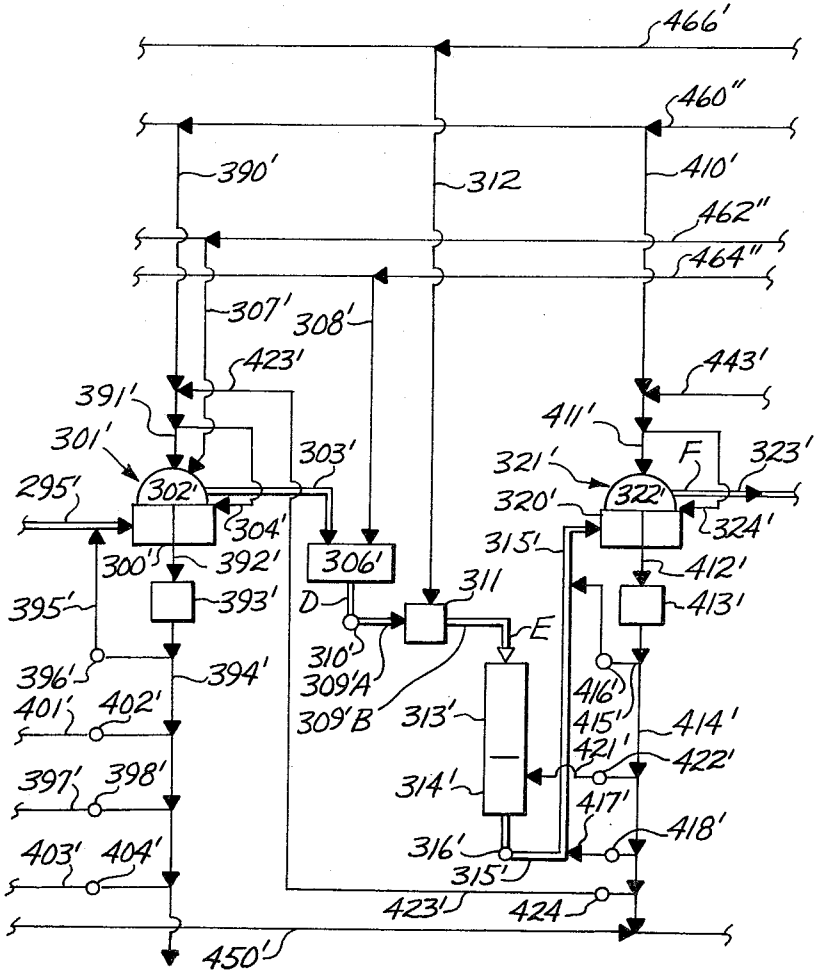
FIG. 27 is a diagram showing the mixer used in an extraction stage.

FIG. 27 shows the mixer being used to add oxygen in a standard caustic extraction stage of a bleaching system. It shows that the simple addition of the mixer can turn a caustic extraction stage into an oxygen bleaching stage. To allow comparison of this extraction stage with one in FIG. 25, the same reference numerals have been used. The flows of pulp and wash water through the system are also the same as in FIG. 25.

The pulp 295' enters washer 301' where it is washed, dewatered and treated with alkali, usually sodium hydroxide. The consistency of the pulp leaving the washer is usually in the range of 8 to 15%. The exiting pulp 303' then is mixed with the alkali and steam in steam mixer 306'. The pulp consistency is reduced about 1% in the steam mixer. From the steam mixer the pulp goes to extraction tower 313' where it remains for the usual period of time. It is diluted and carried to washer 321', where it is washed and dewatered.

Although washer 321' may be a diffusion washer, it is shown and described as a vacuum or pressure drum washer.

In washer 321' the water is either fresh process water through line 410', counterflow filtrate through line 443' or a combination of these, and in washer 301' the wash water is either fresh process water through line 390', or counterflow filtrate through line 423', or a combination of these.

The filtrate from washer 301' is stored in seal tank 393' and is used as dilution water through lines 395', 397' and 401', as wash water through line 403', or sent to effluent treatment through line 394'. It is shown being treated separately from effluent in line 450' because the effluent, if from a chlorine stage, would be treated separately from effluent from an oxygen stage.

Similarly, the filtrate from washer 321' is stored in seal tank 413' and used as dilution water through lines 415', 417' and 421', as wash water through line 423', or treated as effluent through line 414'. Since the oxygen effluent has little, if any, chlorine components, it may be combined with the effluent from the brownstock washers and the digester and be treated in the recovery furnace thus reducing the amount of material that must be sewered to an adjacent stream or body of water.

The supply lines are 460'' for process water, 462'' for sodium hydroxide solution and 464'' for steam.

The description of the stage so far is, with the exception of splitting the effluent stream, identical to the description of the extraction stage in FIG. 25. Only one minor change is required to turn this extraction stage into an oxygen stage. That is the addition of the mixer 311 into line 309', of the oxygen line 312 to the mixer 311 and of the oxygen supply line 466'. The pulp leaves steam mixer 306' through line 309'A and enters the oxygen mixer 311 and the oxygenated pulp leaves the mixer 311 through line 309'B and enters extraction tower 313'. The amount of oxygen supplied to the pulp would be 11 to 28 kilograms per metric ton of oven-dry pulp. A preferred range is 17 to 22 kilograms of oxygen per metric ton of oven-dry pulp.

The operating conditions—time, temperature, pressure, consistency, pH and chemical addition—may remain about the same as they were in the extraction stage shown in FIG. 25. The amount of alkali, expressed as sodium hydroxide, is 0.5 to 7% of the weight of the oven-dry pulp. The temperature would normally be increased from 71°-77° C. for an extraction stage to 82°-88° C. for an oxygen bleaching stage, because the bleaching effect is improved at higher temperatures. The temperature may be as high as 121° C.

The operation of the various pieces of equipment—the washers 301' and 321', the steam mixer 306', the extraction tower 313' and the seal tanks 393' and 413'—are the same as in the prior art extraction stage in FIG. 25. If the extraction tower was a downflow tower, it remains a downflow tower. The physical location of mixer 311 is a matter of convenience, the simplicity of installation and maintenance being the sole criteria. If it can be placed in an existing line, it will be. If convenience requires that it be placed on the floor of the bleach plant, it will be placed on the floor of the bleach plant and an external pipe can carry the pulp slurry to the top of the extraction tower 313'.

A back pressure on the mixer 311 would be provided by either an upflow leg in line 309'B, a pressure valve in line 309'B or a combination of the upflow leg and the pressure valve as described earlier. The maximum pressure would be the same as described earlier.

Channeling of the oxygen after mixing is of no particular consequence. The presence of some large bubbles and gas pockets up to the size of the pipe through which the pulp slurry was passing have been observed. These have not affected the quality of the pulp or the bleaching of the pulp.

In a mill trial of the system, sampling was done at D, E and F. At point E, sampling was at the top of the tower 313' rather than directly after the mixer 311 because it was not possible to sample after the mixer. It required about 1 minute for the slurry to reach point E from the mixer. In these tests the mixer was on the bleach plant floor and an external line carried the slurry to the top of the tower.

TABLE I

| | PBC | |
|---|---|---|
| D | E | F |
| 1.4 | 1.13 | 0.95 |
| 1.41 | 1.13 | 0.90 |

Figure 28:
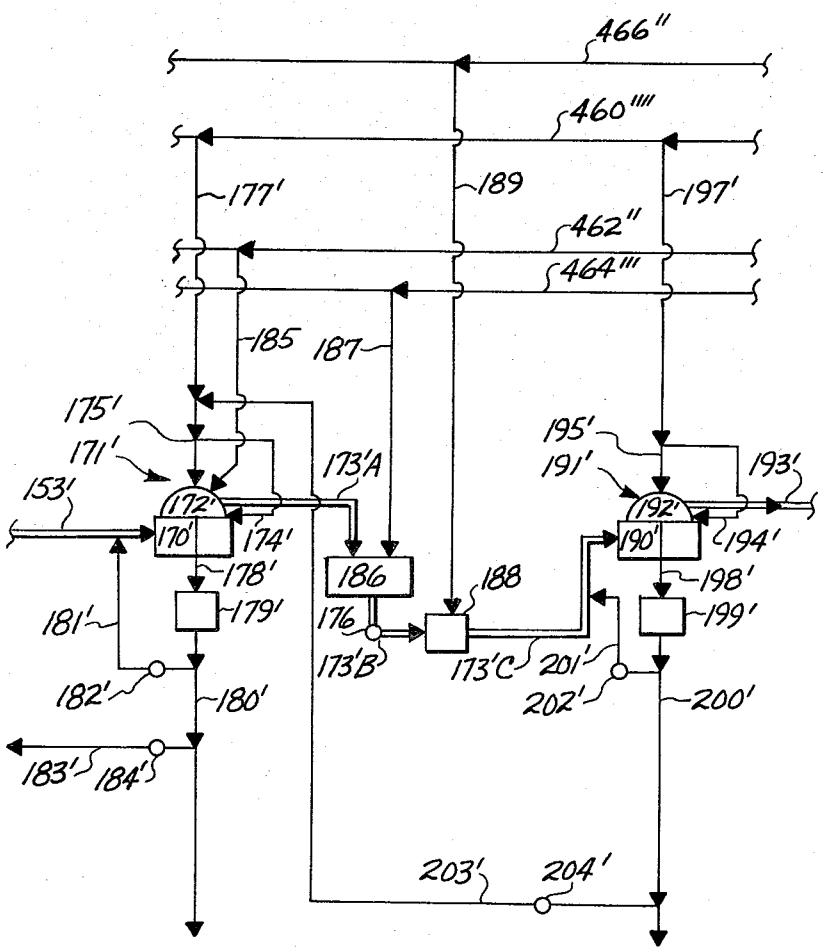
FIG. 28 is a diagram showing the mixer used between washers.

FIG. 28 shows the mixer being used to add oxygen to the pulp between two washers. Again, the reference numerals are the same as those found in FIG. 25 and the conditions in these two washers are the same as those noted for FIG. 25.

The differences between this unit and that in FIG. 25 are the addition of steam mixer 186, pump 176, mixer 188, and lines 185, 187 and 189. Line 185 adds alkali onto the mat 173'A as it is leaving the washer 171'. The amount of alkali, expressed as sodium hydroxide, placed on the mat is between 0.1 and 6%, preferably between 2 and 4%, based on the oven dry-weight of the pulp. The alkali may be added at the steam mixer 186 instead of at washer 171'. The treated mat 173'A is then carried to steam mixer 186 in which it is mixed with the alkali and with steam from line 187 to increase the temperature of the pulp to 65°-88° C. and possibly as high as 121° C. From steam mixer 186 the pulp slurry is carried through line 173'B by a pump 176 to a mixer 188 in which it is mixed with oxygen from line 189. The amount of oxygen added is from 5 to 50 kilograms per metric ton of oven-dry pulp. The amount will depend on the K number of the pulp and the desired result. The reasons for adding oxygen in the brownstock washers are the same as for adding it in the blow line and the same amount would be used. Two ranges for bleaching in the brownstock digester are 8 to 17 kilograms of oxygen per metric ton oven-dry pulp, and 22 to 28 kilograms per metric ton of oven-dry pulp. The oxygenated pulp 173'C then passes to the vat 190' of washer 191'.

Washer 191' may be a diffusion washer. The slurry would not be diluted before entering the washer.

Figure 29:
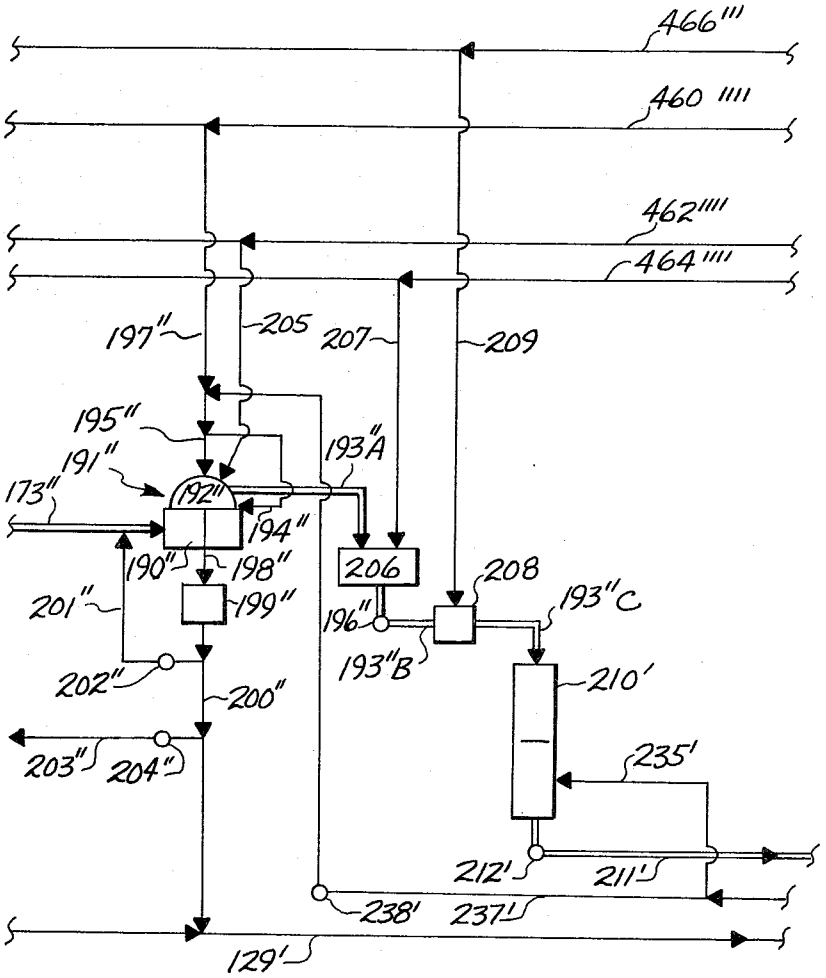
FIG. 29 is a diagram showing the mixer used between a washer and storage.

FIG. 29 discloses a mixer used to add oxygen between a washer such as brownstock washer 191'' and a storage tank such as storage tank 210'. Again the reference numerals are same as those used in FIG. 25. The changes are the addition of steam mixer 206, mixer 208, alkali line 205 and its supply line 462'''', steam line 207 and its supply line 464'''', and oxygen line 209 and its supply line 466'''. The amount of alkali and oxygen added to the pulp, the temperature of the pulp, and the time between alkali addition and oxygen addition is the same as in the system of FIG. 28. The other operating conditions would remain the same as in FIG. 25.

Again, back pressure on mixer 208 would be provided by either an upflow leg on line 193''C, a pressure valve in line 193''C or a combination of an upflow leg and a pressure valve as described earlier.

In each of these systems, the time between alkali addition and oxygen addition is usually from 1 to 5 minutes. The exact time will depend upon equipment placement and pulp speed.

A mill trial was run using the system shown in FIG. 29. In this system, the mixer 208 was floor mounted and a pipe 193''C carried the slurry from the mixer 208 to the top of the tower 210'. The tower was open to the atmosphere. A partially closed valve near the outlet of the pipe 193''C created a 276 kPa gage back pressure in the line. The hydrostatic pressure in the line was 241.5 kPa gage so the pressure within the mixer was 517.5 kPa gage.

Four trial runs were made under slightly different conditions to determine both the overall delignification effect of the system and the percentage of delignification taking place within each section of the system. K number measurements were taken before and after the mixer 208, at the outlet of the pipe 193''C, at the outlet of the tank 210', and at the outlet of the decker 221' (FIG. 30B) downstream of the tank 210'.

In a control run in which no oxygen was added to the system, it was determined that the K number was reduced by 1 number between the inlet of the mixer 208 and the outlet of the decker 221'. This probably was due to screening. In the overall delignification computation, the numbers were corrected for this 1 K number drop.

The various K numbers were taken within the system to determine the percentage of the total delignification or K number reduction taking place through the mixer 208, through the pipe 193''C, through the tank 210', and through the decker 221'. Washer showers had ben added to the decker for these tests. The slurry required between 10 and 15 seconds to pass through the mixer 208, 2½ to 3½ minutes through the pipe 193''C, and ½ to 3 hours through the tank 210' or the decker 221'. It was determined that in these tests, 30% of the total delignification occurred in the mixer 208, 40% occurred in the pipe 193''C, 8% occurred in the tank 210', and 21% occurred between the tank 210' and decker 221'. This latter reduction is caused by screening of the pulp.

Table II gives the actual conditions in the mixer: the temperature in degrees C.; the kilograms of caustic, expressed as sodium hydroxide, and oxygen per oven-dry metric ton of pulp; the pressure in kilopascals gage; the K numbers at the various locations within the system; and the percent K number reduction. In Run No. 1, the percent reduction at the decker outlet in the last line is the reduction between the top of the pipe and the decker outlet.

TABLE II

| | Runs | | | |
|---|---|---|---|---|
| | 1 | 2 | 3 | 4 |
| Mixer Conditions | | | | |
| Temp. °C. | 79.5 | 82 | 93 | 88 |
| Caustic, kg/O.D.t. | 15.1 | 20.2 | 15.1 | 20.2 |
| Oxygen, kg/O.D.t. | 22.7 | 25.2 | 20.2 | 25.2 |
| Pressure, kPa gage | 517.5 | 517.5 | 517.5 | 517.5 |

TABLE II-continued

| | Runs | | | |
|---|---|---|---|---|
| | 1 | 2 | 3 | 4 |
| Overall Delignification | | | | |
| Before Mixer | | | | |
| K No. | 19.6 | 25.4 | 19.9 | 24.1 |
| K No. Corrected | 18.6 | 24.4 | 18.9 | 23.1 |
| After Decker | | | | |
| K No. | 15.6 | 19.2 | 15.1 | 17.8 |
| % K No. Reduction | 16 | 21 | 20 | 23 |
| Delignification Within System | | | | |
| Mixer Inlet | | | | |
| K No. | 19.6 | 25.4 | 19.9 | 24.1 |
| Mixer Outlet | | | | |
| K No. | 18.5 | 23.3 | 18.6 | 21.3 |
| % of Total Reduction | 25 | 34 | 27 | 29 |
| Top of Pipe | | | | |
| K No. | 16.8 | 21.5 | 16.0 | 19.8 |
| % of Total Reduction | 44 | 29 | 54 | 40 |
| Tank Outlet | | | | |
| K No. | — | 20.5 | 16.0 | 19.3 |
| % of Total Reduction | — | 16 | 0 | 8 |
| Decker Outlet | | | | |
| K No. | 15.6 | 19.2 | 15.1 | 17.8 |
| % of Total Reduction | 31 | 21 | 19 | 23 |

This data indicates that a valve should be placed in the line downstream of the mixer to provide back pressure on the mixer. It also indicates that much of the treatment occurs in less than a minute in the mixer. It may be 10–15 seconds or less. Most will occur in a few minutes in the mixer and the outlet pipe immediately after the mixer.

Figure 30A:
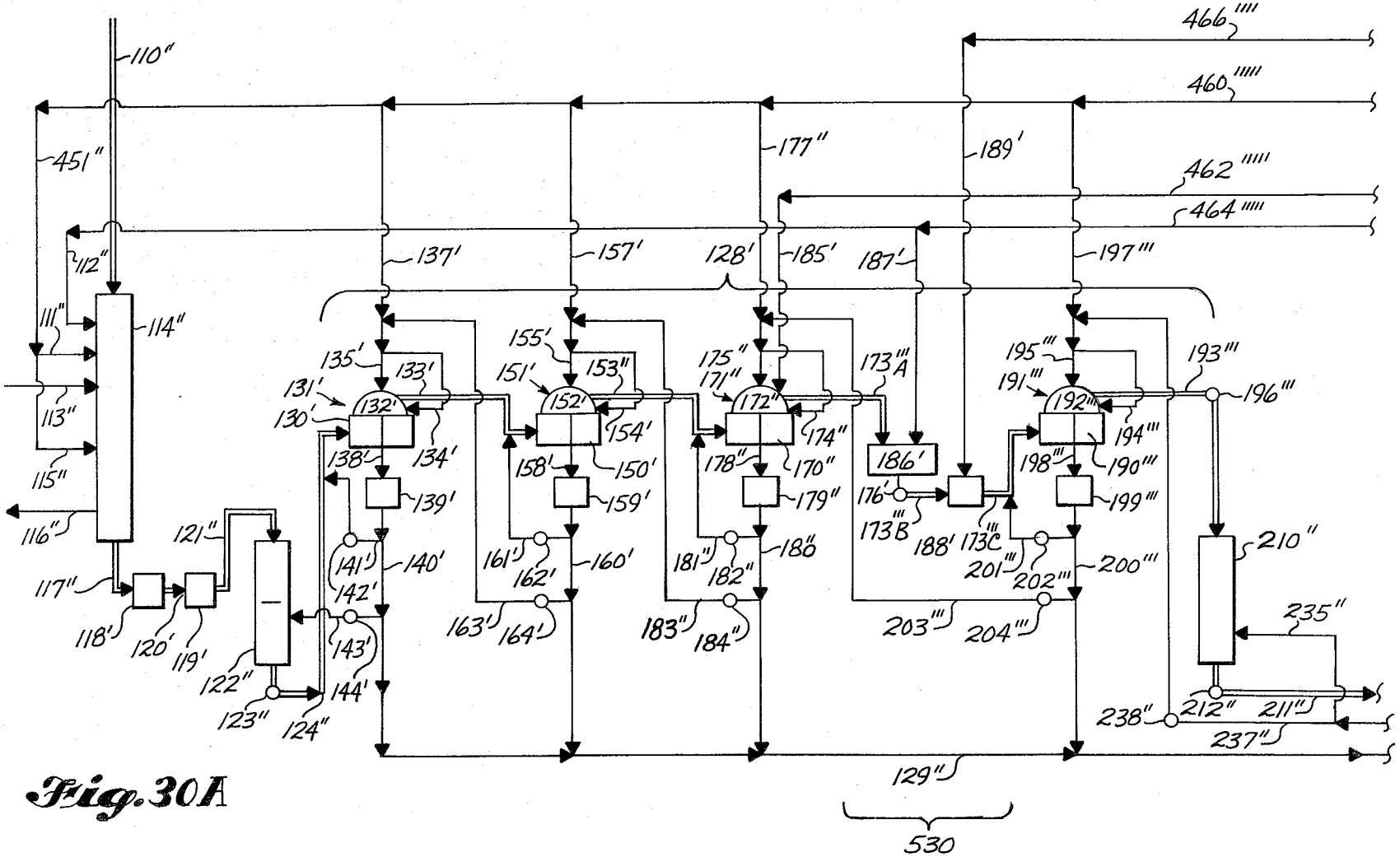
FIGS. 30 (A-C) is a diagram of a pulping and bleaching process showing the mixer being used at various places within the process.
Figure 30B:
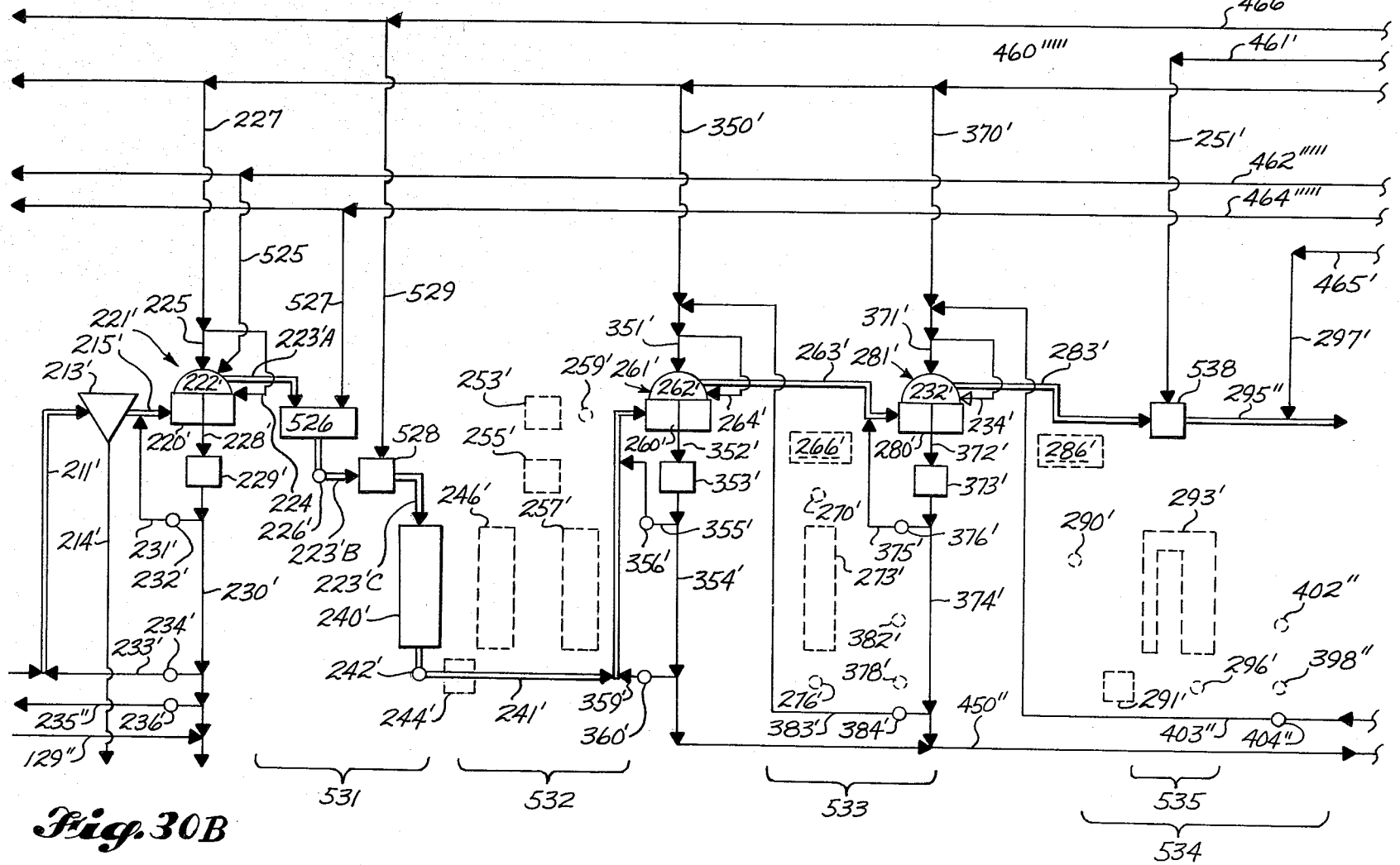
Figure 30C:
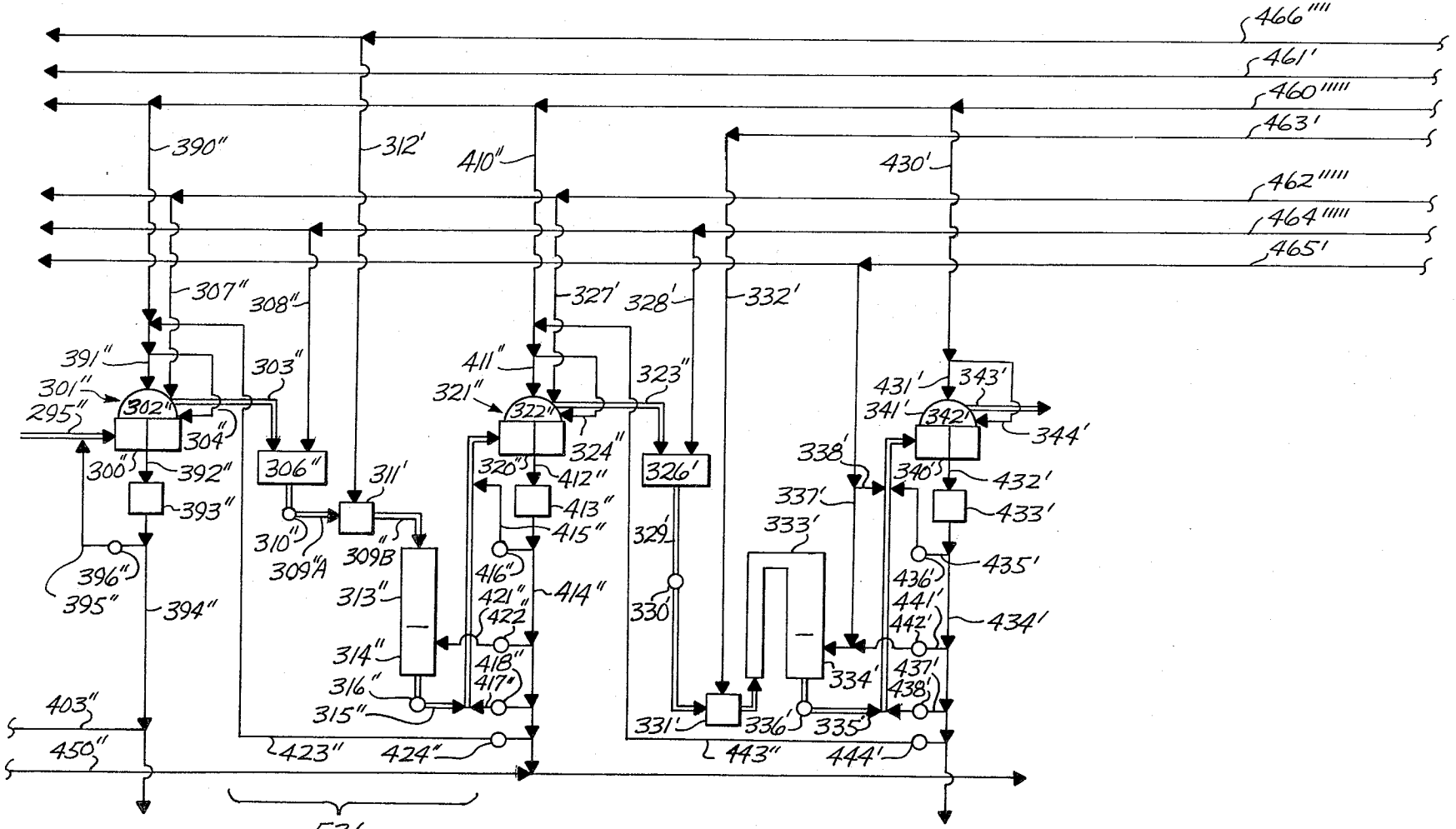

The mixer placements of FIGS. 27, 28 and 29 are shown in the bleaching system in FIG. 30. FIG. 30 shows the same overall pulping and bleaching system as FIG. 25 and the same reference numerals are used throughout these figures. The system shown in FIG. 25 includes digestion of the wood chips in either a batch or continuous digester, brownstock washing, screening, dewatering in decker 221 and a $D_c$EDED bleach sequence. FIG. 30 shows digestion, brownstock washing, screening, and an OOCOD bleach sequence. For the most part, the operating conditions—time, temperature, pH, consistency and chemical addition—are the same in FIG. 30 as they were in FIG. 25.

The differences between the system in FIG. 30 and that in FIG. 25 is indicated by brackets at the bottom of FIG. 30.

The first difference between the process shown in FIG. 30 and that shown in FIG. 25 is indicated by bracket 530. This is the system of FIG. 28 and again the reference numerals and operating conditions for this stage are the same as that given for the stage in FIG. 28. Since an oxygen bleaching stage requires washed pulp, the oxygen stage 530 in FIG. 29 is shown after the third brownstock washer to indicate its placement after a batch digester in which no washing would occur in the digester. With a continuous digester, there would be fewer brownstock washers, and the oxygen stage could be earlier in the brownstock system.

The next change is shown by bracket 531. This is a modification of the system of FIG. 29. There should be at least two stages of washing after an oxygen bleach stage. The two washing stages after the oxygen stage at bracket 530 are washer 191''' and decker 221' to which washer showers have been added. If the oxygen stage at bracket 530 had been after the second brownstock washer 151' rather than the third brownstock washer 171'', then the oxygen system 531 could have been between washer 191''' and storage tank 210'' as shown in FIG. 29.

In the system shown, the decker 221' has been converted to a washer by the addition of washer heads 225, a process water line 227 and a clean-up washer 224. The system has been further modified into an oxygen system by the addition of an alkali line 525, a steam mixer 526, a steam line 527, a mixer 528 and an oxygen line 529. These are placed between the decker 221' and the high-density storage tank 240'. The operation is the same as that described for FIG. 29.

The next change is at bracket 532. This shows, in dotted line, the elimination of the chlorine and chlorine dioxide equipment. The chlorine dioxide mixer 244', the chlorine dioxide tower 246', the chlorine aspirator 253', the chlorine mixer 255', the chlorine tower 257', and the pump 259' are eliminated. The piping and chemicals associated with this equipment are also eliminated.

The next change is at bracket 533. This bracket indicates the elimination of the extraction equipment between washers 261' and 281' so that these washers may be used as the two stages of washing after the oxygen stage at bracket 531. This is also indicated by the elements in dotted line. The eliminated items are the steam mixer 266', the extraction tower 273', and the pumps 270', 276', 378' and 382'. Again, the piping and chemical additions required by an extraction stage are also eliminated. The pump 270' may be retained to move the pulp 263' to washer 281' if this is necessary.

The next two changes are shown by brackets 534 and 535. Bracket 534 indicates the elimination of the chlorine dioxide stage and bracket 535 its replacement by a mixer which is used to add chlorine. The elimination of the chlorine dioxide stage results in the elimination of steam mixer 286', chlorine dioxide mixer 291', chlorine dioxide tower 293', and pumps 290', 296', 398'' and 402'', their associated piping and chemicals. These are replaced by a mixer 538 for chlorine and the chlorine supply line 251'. A chlorine tower is not required. The pump 290' may be retained if it is required to move the pulp 283' to the mixer 530. The chlorine effluent in line 394'' is maintained separate from the oxygen effluent.

Residence time in the mixer, for either oxygen or chlorine, is less than 1 minute, and normally would be only a few seconds. Pulp traveling at 18.3 meters per second would pass through an 2.4 or 3 meter long reactor in an exceedingly short time. The chlorine would be treated at the temperature of the pulp from the washer, 54° to 60° C., rather than the usual cooler chlorination temperature.

The last change is shown by bracket 536. This is the mixer used for oxygen addition to an extraction stage as shown in FIG. 27. The reference numerals and operating conditions are again the same as in FIG. 27.

Figure 31A:
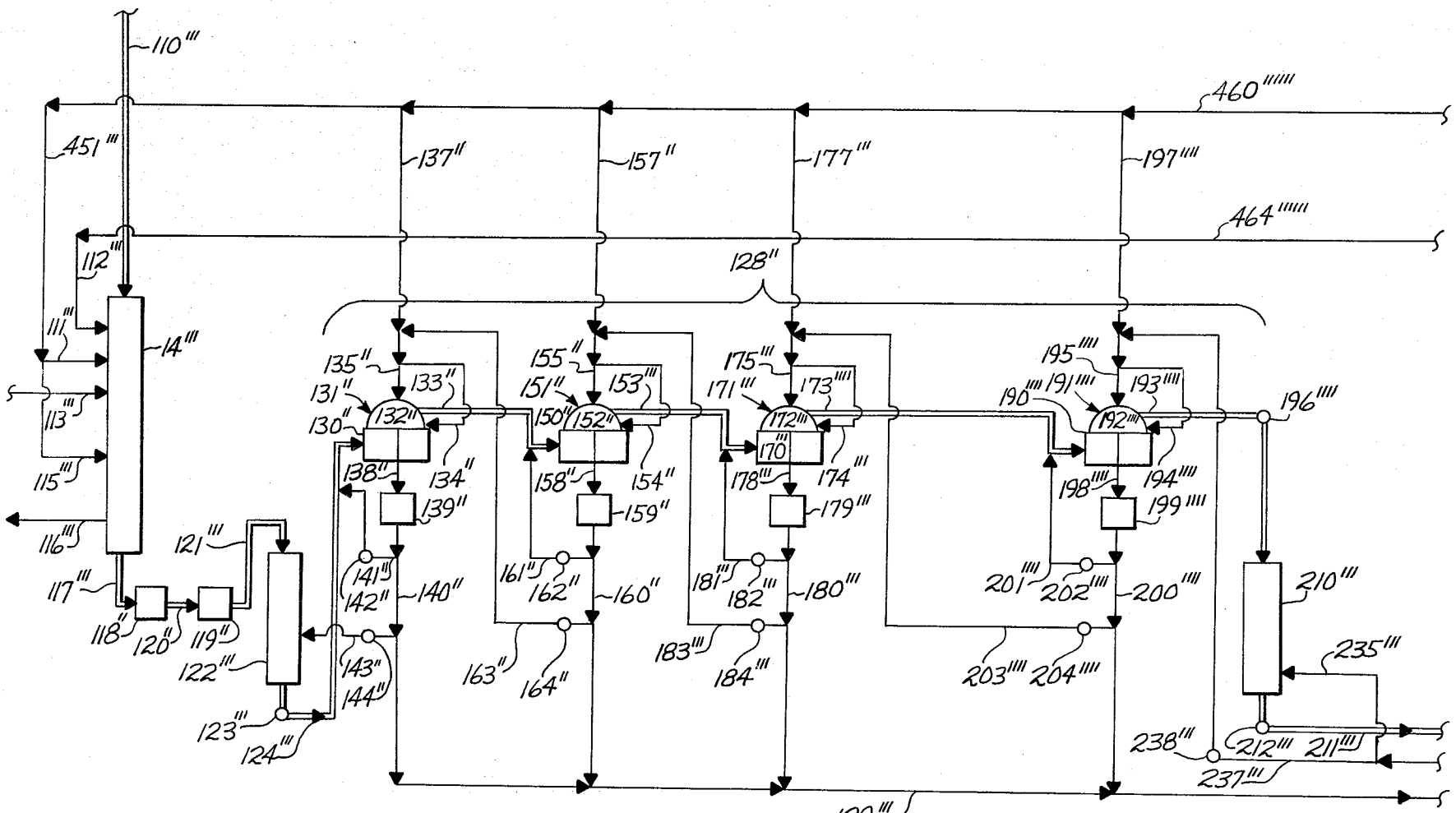
FIGS. 31 (A-C) is a diagram of a pulping and bleaching process showing different uses of the mixer in the process.
Figure 31B:
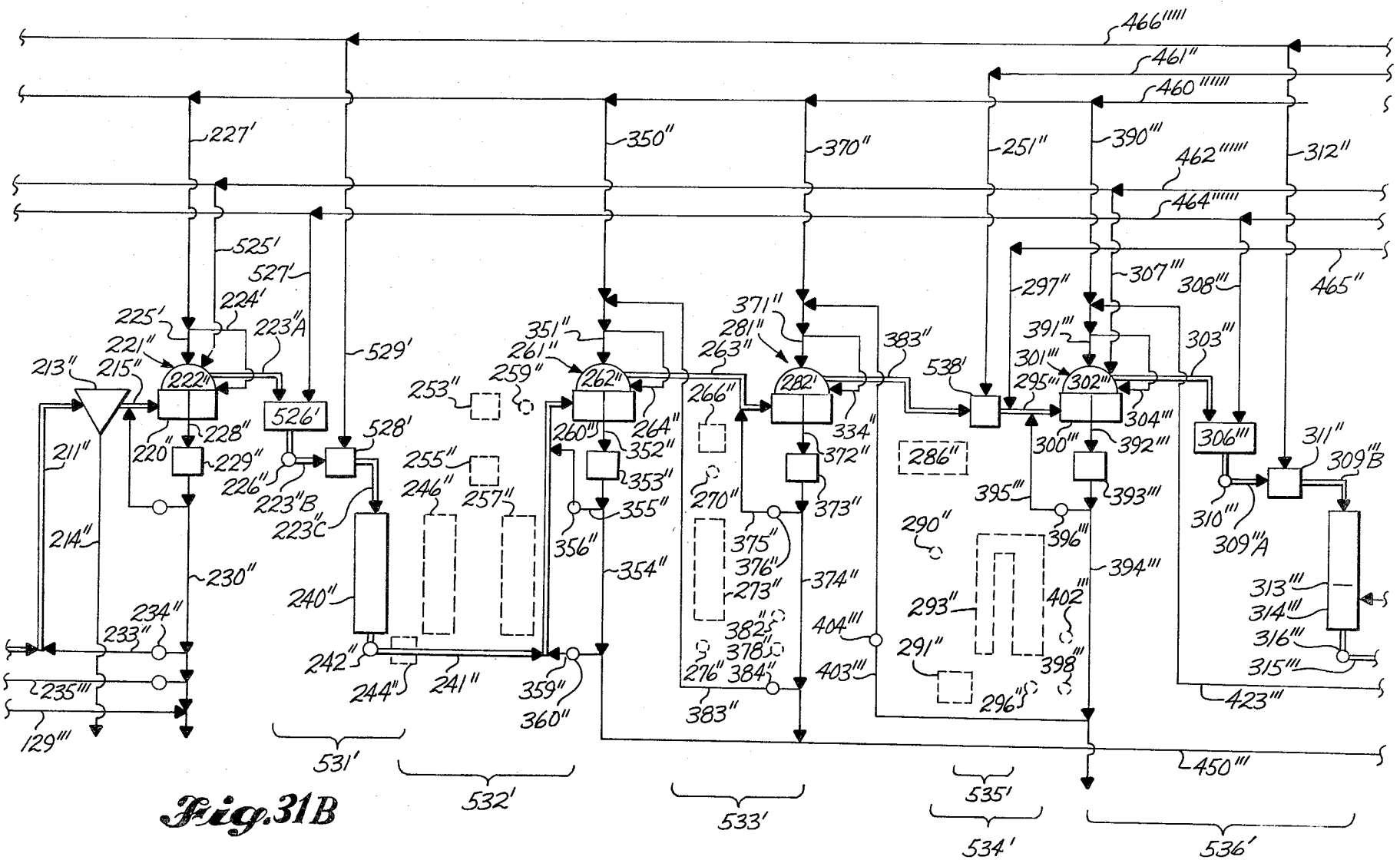
Figure 31C:
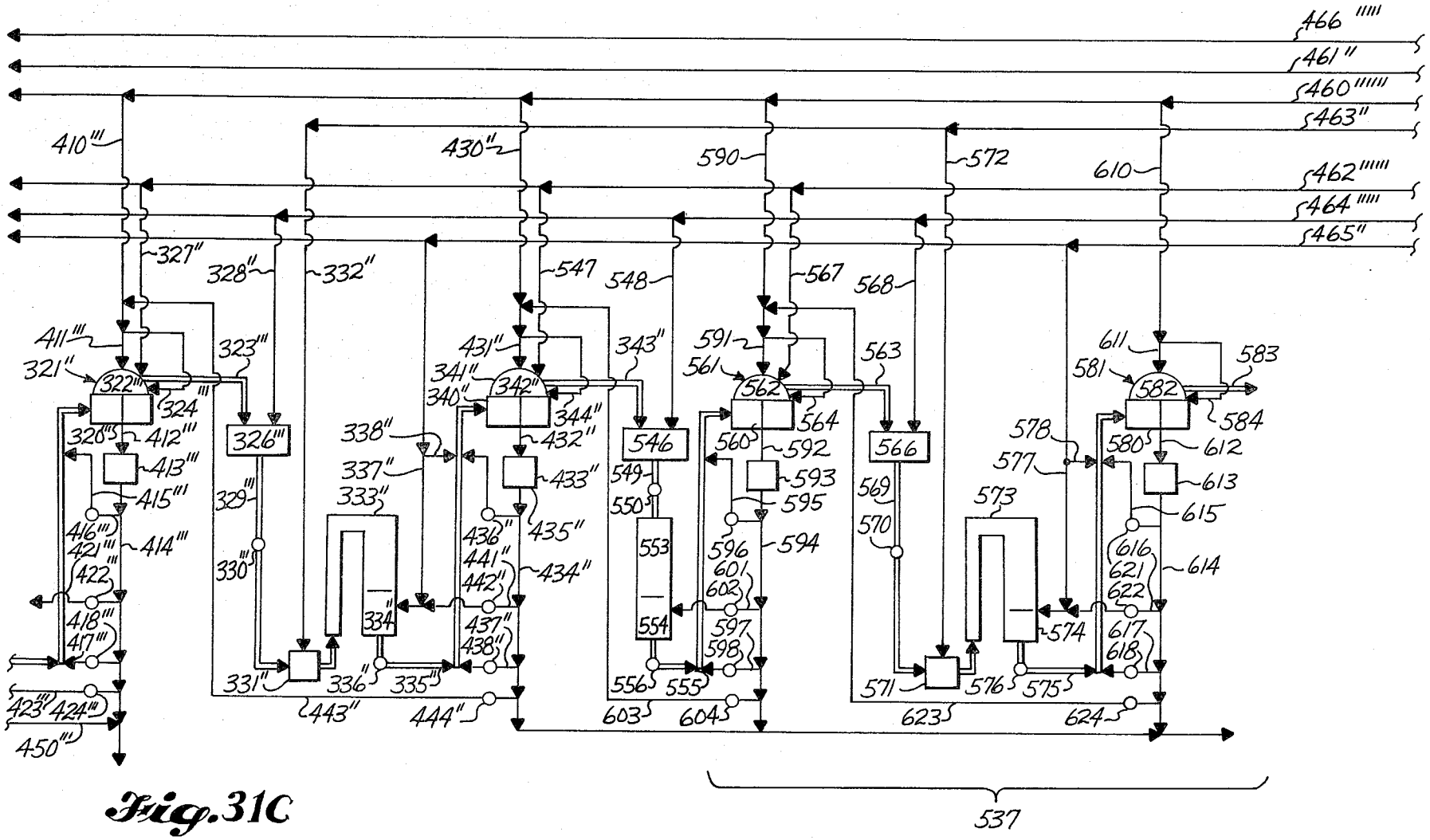

FIG. 31 shows another arrangement in which the bleach sequence is OCODED. Again, the changes between FIG. 31 and FIG. 25 are shown by the brackets in FIG. 31. Changes 531'–536' are the same as those shown in FIG. 30. The same reference numerals and operating conditions are used in FIGS. 25, 30 and 31.

There is one other change indicated by bracket 537. This is the addition of E and D stages at the end of process. Again, the process conditions for this last extraction stage are the same as those for the other extraction stages and for this last chlorine dioxide stage are the same as those for the other chlorine dioxide stages. It should also be realized that the only additional equipment required for these two stages are the two additional washers. The extraction equipment that was eliminated at 533' can be used in this extraction stage and the chlorine dioxide equipment eliminated at 534' can be used in this chlorine dioxide stage. In an actual modification, this equipment would be left in place and repiped.

For the purposes of the present description, however, new reference numerals will be used for these last stages.

In the E stage, the steam mixer is 546, the alkali line 547, the steam line 548, the slurry line 549, the pump 550, the extraction tower 553, the dilution zone 554, the line from the tower to the washer 555 and the pump 556.

In the extraction washer, the vat is 560, the washer 561, the drum 562, the exiting pulp 563, the cleanup washer 564, the incoming process water 590, the washer heads 591, the filtrate line 592, the seal tank 593, the effluent line 594, the dilution lines 595, 597 and 601 and their respective pumps 596, 598 and 602, and the counterflow wash water line 603 and its pump 604.

In the last chlorine dioxide stage, the steam mixer is 566, the alkali line 567, the steam line 568, the pulp slurry line 569, the pump 570, the chlorine dioxide mixer 571, the chlorine dioxide line 572, the chlorine dioxide tower 573, the dilution zone 574, the line from the tower to the washer 575, its pump 576, and the sulfur dioxide lines 577 and 578.

In the last washer, the vat is 580, the washer 581, the drum 582, the exiting pulp 583, the cleanup washer 584, the incoming process water 610, the washer heads 611, the filtrate line 612, the seal tank 613, the effluent line 614, the dilution lines 615, 617 and 621 and their pumps 616, 618 and 622, and the counterflow wash line 623 and its pump 624.

Again, each of the gas mixers should be under a back pressure, as described earlier.

Figure 32:
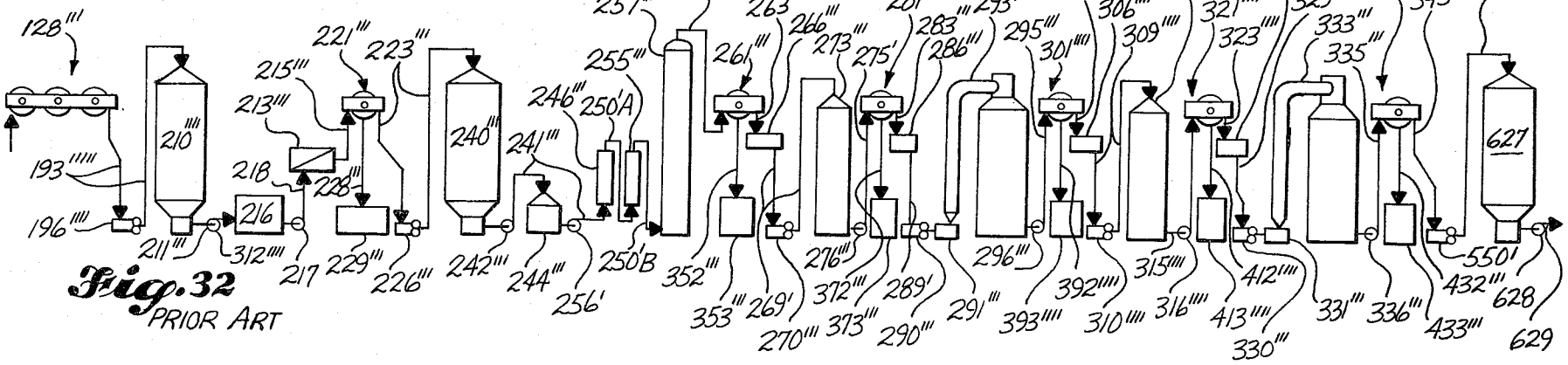
Fig. 32 PRIOR ART
FIG. 32 is another diagram of a prior art bleaching system.
Figure 33:
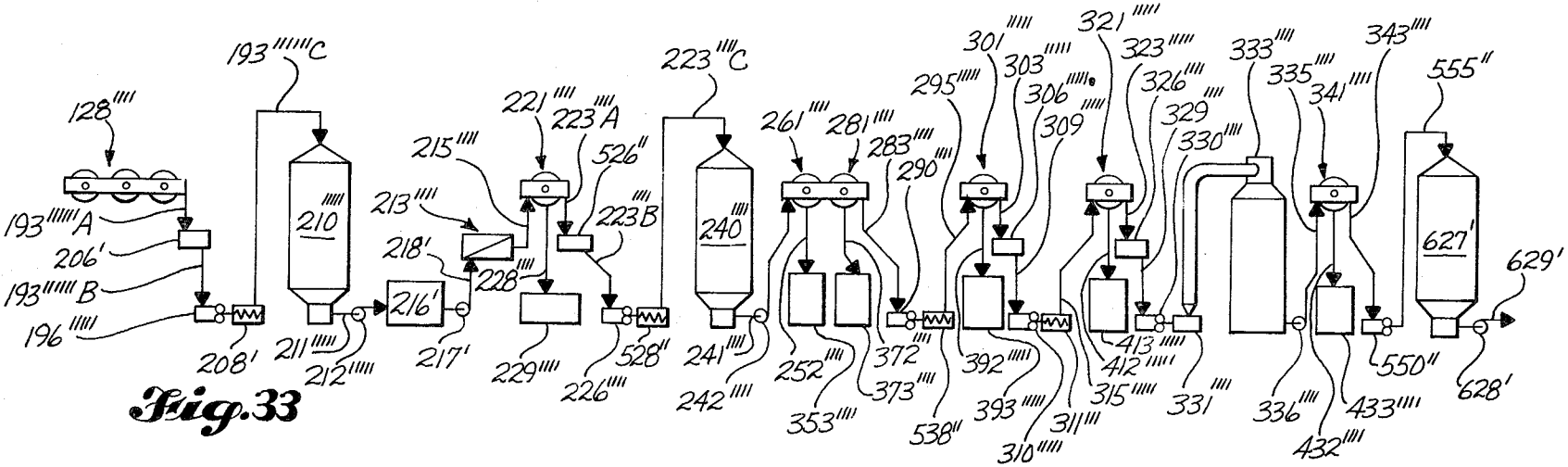
FIG. 33 is a diagram of a pulping and bleaching process using the mixer.

The next two figures, 32 and 33, illustrate the difference in equipment between a prior art bleach plant having a $D_c$EDED bleach sequence and a plant using the present mixers having an OOCOD sequence. Each sequence starts at the brownstock washers and ends at a storage tank. The sequence in FIG. 32 is the same as in FIG. 25-$D_c$EDED. The sequence in FIG. 33 is the same as in FIG. 30-OOCOD. The reference numerals in FIGS. 32 and 33 are the same as those used in FIGS. 25 and 30 and relate to the same pieces of equipment.

In FIG. 32, the pulp 193'''' from brownstock washers 128''' is carried by thick stock pump 196'''' to high-density storage 210''''. From storage, the pulp slurry is moved through line 211'''' by pump 212'''' to a mix tank 216 in which it is mixed with water to reduce its consistency. From tank 216, a pump 217 carries the pulp slurry through line 218 to screens 213'''. Then the pulp slurry 215''' enters decker 221''' where it is dewatered. The filtrate goes through filtrate line 228''' into seal tank 229''', while the pulp 223''' is moved by thick stock pump 226''' to high-density storage 240'''.

From high-density storage 240''', the pulp is moved through line 241''' by pumps 242''' and 256' and mixed with chlorine dioxide in tank 244'''. Thereafter it goes into chlorine dioxide tower 246''' and leaves this tower through line 250'. While in line 250', it is mixed with chlorine in mixer 255''' and carried to chlorine tower 257'''. The chlorinated material leaves the chlorine tower 257''' through line 258' and the extraneous material is washed from it in washer 261'''. The filtrate passes through line 352''' into seal tank 353'''.

The pulp 263''' exits the washer, goes to steam mixer 266''' and is mixed with sodium hydroxide and steam and carried through line 269' by a thick stock pump 270''' to extraction tower 273'''. The alkali in this extraction stage, as in the other, may be added at the washer or the mixer. The extracted pulp is moved through line 275' by pump 276''' to washer 281'''. The filtrate from this washing step leaves through line 372''' into seal tank 373'''. The pulp 283''' passes to steam mixer 286''' and again mixed with steam and sodium hydroxide. It then is carried through line 289' by thick stock pump 290''' to chlorine dioxide mixer 291''' and chlorine dioxide tower 293'''. From the chlorine dioxide tower, the pulp slurry is carried through line 295'''' by pump 296''' to washer 301''''. Again, the filtrate from this washer is carried through line 392'''' to seal tank 393'''' while the exiting pulp 303'''' passes to steam mixer 306'''' to be mixed with sodium hydroxide and steam and carried through line 309'''' by thick stock pump 310'''' to extraction tower 313''''.

From the tower, the slurry is carried through line 315'''' by pump 316'''' to washer 321'''' and washed. The filtrate leaves the washer through line 412'''' to seal tank 413'''', while the pulp 323'''' is mixed with steam and possibly sodium hydroxide in steam mixer 326'''. From the steam mixer, the pulp is carried through line 329''' by thick stock pump 330''' to the chlorine dioxide mixer 331''' and the chlorine dioxide tower 333'''. The pulp slurry is then carried through line 335''' by pump 336''' to washer 341''' where it is again washed. The filtrate passes through line 432''' to seal tank 433'''. The pulp 343''' is carried by thick stock pump 550' through line 555' to storage tank 627. From the storage tank, the material is carried by pump 628 through line 629 to any additional processing.

This should be contrasted with the oxygen system shown in FIG. 33. The eight storage tanks of the prior system have been reduced to four storage tanks in the present system. This number could be reduced to three because the one chlorine dioxide tower in the system shown in FIG. 33 can also be eliminated. Its purpose is as a storage tank within the system. It need not be used as a chlorine dioxide tower.

In both systems, the material begins with the same PBC and ends with the same PBC. Consequently, this same result is achieved with a great decrease in capital cost in the new system. There are other savings also.

In the system shown in FIG. 33, the pulp 193'''''A from brownstock washers 128'''' is mixed with sodium hydroxide and steam in steam mixer 206' and carried through line 193'''''B by thick stock pump 196''''' to mixer 108' where the pulp is mixed with oxygen and thereafter through line 193'''''C to high-density storage tank 210'''''.

From this first oxygen stage, the pulp slurry is carried through line 211''''' by pump 212''''' to tank 216' and from there through line 218' by pump 217' to screens 213''''. From the screens, the pulp 215'''' goes across decker 221''''. The filtrate from the decker is carried through line 228'''' to seal tank 229'''', while the pulp 223''''A is carried to steam mixer 526'', mixed with sodium hydroxide and steam and then carried through line 223''''B by thick stock pump 226'''' to mixer 528'' when the pulp is mixed with oxygen. From the mixer 528'', the material passes through line 223''''C to high-density storage 240''''.

The pulp slurry from the high-density storage is carried through line 241'''' by pump 242'''' to washers 261'''' and 281''''. The filtrate from these two washers passes through lines 352'''' and 372'''' to seal tanks 353'''' and 373'''' respectively. The pulp 283'''' from washer 281'''' is carried by thick stock pump 290'''' to mixer 538'' where the pulp is mixed with chlorine. From the mixer, the slurry passes through line 295''''' to washer 301'''''. The filtrate from this washer passes through line 392''''' to seal tank 393'''''. The pulp 303''''' is carried to steam mixer 306''''', mixed with sodium hydroxide and steam and then carried through line 309''''' by thick stock pump 310''''' to mixer 311''' where the pulp is mixed with oxygen. From the mixer 311''', the pulp passes through line 315''''' to washer 321'''''. The filtrate from this washer passes through line 412''''' to seal tank 413'''''.

The pulp 323''''' from washer 321''''' passes to steam mixer 326'''', is mixed with sodium hydroxide and steam and carried through line 329'''' by thick stock pump 330'''' to chlorine dioxide mixer 331''''. From the mixer, it goes to chlorine dioxide tower 333''''. A mixer may be used in place of the chlorine dioxide mixer and tower.

After the tower, the pulp slurry is carried through line 335'''' by pump 336'''' to washer 341''''. The filtrate from this washer passes through line 432'''' to seal tank 433'''' and the pulp 343'''' is moved by thick stock pump 550'' through line 555'' to storage tank 627'. From this tank, it may be moved by pump 628' through line 629' to any subsequent operation.

In the process shown in FIGS. 32 and 33, the sodium hydroxide, or other alkali, may be added either at a washer or at a steam mixer.

Again there should be a back pressure in the mixers.

The amount of oxygen and the chemical used will depend, of course, on the K number of the unbleached pulp, the desired brightness and the number of bleach stages. As an example, an OOCOD sequence might use 14 to 20 kilograms of oxygen and 22 to 28 kilograms of sodium hydroxide per metric ton of oven-dry pulp in the first stage; 11 to 17 kilograms of oxygen and 17 to 22 kilograms of sodium hydroxide per metric ton of oven-dry pulp in the second stage; around 56 kilograms of chlorine per metric ton of oven-dry pulp in the third stage; 8 to 11 kilograms of oxygen per metric ton of oven-dry pulp in the fourth stage; and 14 to 16 kilograms of chlorine dioxide per metric ton of oven-dry pulp in the last stage. The temperature of the pulp would not be changed from the temperature of the washer for the chlorine treatment.

These illustrate OOC and OCO sequences, and are exemplary of O-O-X and O-X-O sequence in general. In either sequences X may be chlorine, chlorine dioxide, combination of chlorine or chlorine dioxide-$C_D$, $D_c$ or mixture of chlorine and chlorine dioxide, hypochlorites, peroxides or ozone. The mixers to be described may be used to mix these. The pulp may be treated with ozone by the treatment described in U.S. Pat. No. 4,216,054 granted Aug. 5, 1980 or U.S. Pat. No. 4,229,252 granted Oct. 21, 1980.

What is claimed is:

1. The process of mixing a chemical selected from the group consisting of noncondensable gases, unsaturated gases and highly superheated steam with a wood pulp having a consistency of 7 to 15%, comprising passing said pulp through a mixing zone, adding said chemical to said pulp in said mixing zone, said mixing zone having a series of rotating members passing through said pulp in a direction transverse the direction of travel of said pulp, said members having a major axis extending in the direction of rotation, said members providing a swept area through said pulp of 10,000 to 1,000,000 square meters per metric ton of oven dry pulp, said members having leading and trailing edges, said leading edge having a radius of curvature in the range of 0.5 to 15 mm.

2. The process of claim 1 in which said swept area is 14,100 to 1,000,000 square meters per metric ton of oven dry pulp.

3. The process of claim 1 in which said swept area is 25,000 to 150,000 square meters per metric ton of oven dry pulp.

4. The process of claim 1 in which said swept area is around 65,400 square meters per metric ton of oven dry pulp.

5. The process of claims 1, 2, 3 or 4 in which said members have elliptically generated cross sections having a major axis extending in the direction of rotation.

6. The process of claims 1, 2, 3 or 4 in which said mixing occurs in an annular space in which the interior surface of said space has a radius of at least one half of the radius of the exterior surface of said space.

7. The process of claims 1, 2, 3 or 4 in which said trailing edge has a radius of curvature in the range of 0.5 to 15 mm.

8. The process of claims 1, 2, 3 or 4 in which said chemical is added incrementally to said pulp.

9. The process of claims 1, 2, 3 or 4 in which said mixing takes place under a pressure of up to 830 kPa gage.

10. The process of claims 1, 2, 3 or 4 in which said members have elliptically generated cross sections having a major axis extending in the direction of rotation, and said pulp slurry is subject to a pressure of up to 830 kPa gage.

11. The process of claims 1, 2, 3 or 4 in which said mixing zone is an annular space in which the interior surface of said space has a radius of at least one half of the radius of the exterior surface of said space, and said mixing takes place under a pressure of up to 830 kPa gage.

12. The process of claims 1, 2, 3 or 4 in which said trailing edge has a radius of curvature in the range of 0.5 to 15 mm, and said mixing takes place under a pressure of up to 830 kPa gage.

13. The process of claim 1 further comprising adjusting said pulp to said consistency of 7 to 15%.

14. The process of claim 13 in which said swept area is 14,100 to 1,000,000 square meters per metric ton of oven dry pulp.

15. The process of claim 13 in which said swept area is 25,000 to 150,000 square meters per metric ton of oven dry pulp.

16. The process of claim 13 in which said swept area is around 65,400 square meters per metric ton of oven dry pulp.

17. The process of claims 13, 14, 15 or 16 in which said members have elliptically generated cross sections having a major axis extending in the direction of rotation.

18. The process of claims 13, 14, 15 or 16 in which said mixing occurs in an annular space in which the interior surface of said space has a radius of at least one half of the radius of the exterior surface of said space.

19. The process of claims 13, 14, 15 or 16 in which said trailing edge has a radius of curvature in the range of 0.5 to 15 mm.

20. The process of claims 13, 14, 15 or 16 in which said chemical is added incrementally to said pulp.

21. The process of claims 13, 14, 15 or 16 in which said mixing takes place under a pressure of up to 830 kPa gage.

22. The process of claims 13, 14, 15 or 16 in which said members have elliptically generated cross sections having a major axis extending in the direction of rotation, and said mixing takes place under a pressure of up to 830 kPa gage.

23. The process of claims 13, 14, 15 or 16 in which said mixing zone is an annular space in which the interior surface of said space has a radius of least one half of the radius of the exterior surface of said space, and said mixing takes place under a pressure of up to 830 kPa gage.

24. The process of claims 13, 14, 15 or 16 in which said trailing edge has a radius of curvature in the range of 0.5 to 15 mm, and said mixing takes place under a pressure of up to 830 kPa gage.

25. The process of claim 1 in which said chemical is selected from the group consisting of oxygen, ozone, air, chlorine, chlorine dioxide, sulphur dioxide, ammonia, nitrogen, carbon dioxide, hydrogen chloride, nitric oxide, nitrogen peroxide and highly superheated steam.

26. The process of claim 25 in which said swept area is 14,100 to 1,000,000 square meters per metric ton of oven dry pulp.

27. The process of claim 25 in which said swept area is 25,000 to 150,000 square meters per metric ton of oven dry pulp.

28. The process of claim 25 in which swept area is around 65,400 square meters per metric ton of oven dry pulp.

29. The process of claims 25, 26, 27 or 28 in which said members have elliptically generated cross sections having a major axis extending in the direction of rotation.

30. The process of claims 25, 26, 27 or 28 in which said mixing occurs in an annular space in which the interior surface of said space has a radius of at least one half of the radius of the exterior surface of said space.

31. The process of claims 25, 26, 27 or 28 in which said trailing edge has a radius of curvature in the range of 0.5 to 15 mm.

32. The process of claims 25, 26, 27 or 28 in which said chemical is added incrementally to said pulp.

33. The process of claims 25, 26, 27 or 28 in which said mixing takes place under a pressure of up to 830 kPa gage.

34. The process of claims 25, 26, 27 or 28 in which said members having elliptically generated cross sections having a major axis extending in the direction of rotation, and said mixing takes place under a pressure of up to 830 kPa gage.

35. The process of claims 25, 26, 27 or 28 in which said mixing occurs in an annular space in which the interior surface of said space has a radius of at least one half of the radius of the exterior surface of said space, and said mixing takes place under a pressure of up to 830 kPa gage.

36. The process of claims 25, 26, 27 or 28 in which said trailing edge has a radius of curvature in the range of 0.5 to 15 mm, and said mixing takes place under a pressure of up to 830 kPa gage.

37. The process of claim 25 further comprising adjusting said pulp to said consistency of 7 to 15%.

38. The process of claim 37 in which said swept area is 14,100 to 1,000,000 square meters per metric ton of oven dry pulp.

39. The process of claim 37 in which said swept area is 25,000 to 150,000 square meters per metric ton of oven dry pulp.

40. The process of claim 37 in which said swept area is around 65,400 square meters per metric ton of oven dry pulp.

41. The process of claim 37, 38, 39 or 40 in which said members having elliptically generated cross sections having a major axis extending in the direction of rotation.

42. The process of claims 37, 38, 39 or 40 in which said mixing occurs in an annular space in which the interior surface of said space has a radius of at least one half of the radius of the exterior surface of said space.

43. The process of claims 37, 38, 39 or 40 in which said trailing edge has a radius of curvature in the range of 0.5 to 15 mm.

44. The process of claims 37, 38, 39 or 40 in which said chemical is added incrementally to said pulp.

45. The process of claims 37, 38, 39 or 40 in which said mixing takes place under a pressure of up to 830 pKa gage.

46. The process of claims 37, 38, 39 or 40 in which said members have elliptically generated cross sections having a major axis extending in the direction of rotation, and said mixing takes place under a pressure of up to 830 kPa gage.

47. The process of claims 37, 38, 39 or 40 in which said mixing occurs in an annular space in which the interior surface of said space has a radius of at least one half of the radius of the exterior surface of said space, and said mixing takes place under a pressure of up to 830 kPa gage.

48. The process of claims 37, 38, 39 or 40 in which said trailing edge has a radius of curvature in the range of 0.5 to 15 mm, and said mixing takes place under a pressure of up to 830 kPa gage.

49. A mixer for mixing a chemical selected from the group consisting of noncondensable gases, unsaturated gases and highly superheated steam with a slurry comprising a casing, an inlet at one end of said casing and an outlet at the opposite end of said casing, a shaft in said casing, said casing, said inlet and said outlet, and said shaft defining a mixing zone, a plurality of rotors on said shaft in said mixing zone, said rotors having leading and trailing edges, said leading edge having a radius of curvature in the range of 0.5 to 15 mm, said rotors being rotatable through said slurry in a direction transverse to the direction of travel of said slurry, said rotors having a major axis extending in the direction of rotation, means for rotating said rotors, and said rotors providing a swept area of 10,000 to 1,000,000 square meters per metric ton of oven dry solid material in said slurry.

50. The mixer of claim 49 in which said rotors provide a swept area of 14,100 to 1,000,000 square meters per metric ton of oven dry solid material in said slurry.

51. The mixer of claim 49 in which said rotors provide a swept area of 25,000 to 150,000 square meters per metric ton of oven dry solid material in said slurry.

52. The mixer of claim 49 in which said rotors provide a swept area of around 65,400 square meters per metric ton of oven dry solid material in said slurry.

53. The mixer of claims 49, 50, 51 or 52 in which said rotors have elliptically generated cross sections having a major axes extending in the direction of rotation.

54. The mixer of claims 49, 50, 51 or 52 in which said mixing zone is an annular space in which the interior surface of said space has a radius of at least one-half of the radius of the exterior surface of said space.

55. The mixer of claims 49, 50, 51 or 52 in which said trailing edge has a radius of curvature in the range of 0.5 to 15 mm.

56. The mixer of claims 49, 50, 51 or 52 in which said trailing edge has a groove extending lengthwise of said trailing edge.

57. The mixer of claims 49, 50, 51 or 52 in which said rotors are tapered outwardly.

58. The mixer of claims 49, 50, 51 or 52 further comprising a plurality of stators extending into said mixing zone from said casing, at least some of said stators having a first passage extending from outside of said mixing zone lengthwise through said stator and a second passage communicating between said first passage and said mixing zone, and a check valve in said second passage.

59. The mixer of claims 49, 50, 51 or 52 further comprising said rotors having elliptically generated cross sections having a major axis extending in the direction of rotation, a plurality of stators extending into said mixing zone from said casing, at least some of said stators having a first passage extending from outside of said mixing zone lengthwise through said stator and a second passage communicating between said first passage and said mixing zone, and a check valve in said second passage.

60. The mixer of claims 49, 50, 51 or 52 further comprising said mixing zone being an annular space in which the interior surface of said space has a radius of at least one half of the radius of the exterior surface of said space, a plurality of stators extending into said mixing zone from said casing, at least some of said stators having a first passage extending from outside of said mixing zone lengthwise through said stator and a second passage communicating between said first passage and said mixing zone, and a check valve in said second passage.

61. The mixer of claims 49, 50, 51 or 52 in which said trailing edge has a radius of curvature in the range of 0.5 to 15 mm, a plurality of stators extending into said mixing zone from said casing, at least some of said stators having a first passage extending from outside of said mixing zone lengthwise through said stator and a second passage communicating between said first passage and said mixing zone, and a check valve in said second passage.

62. The mixer of claims 49, 50, 51 or 52 further comprising circumferential dams in the interior of said casing, said rotors being aligned with the spaces between said dams, said rotors extending beyond the interior edge of said dams.

63. The mixer of claims 49, 50, 51 or 52 further comprising said mixing zone being an annular space in which the interior surface of said space has a radius of at least one half of the radius of the exterior surface of said space, circumferential dams in the interior of said casing, said rotors being aligned with the spaces between said dams, said rotors extending beyond the interior edge of said dams.

64. The mixer of claims 49, 50, 51 or 52 further comprising said trailing edge has a radius of curvature in the range of 0.5 to 15 mm, circumferential dams in the interior of said casing, said rotors being aligned with the spaces between said dams, said rotors extending beyond the interior edge of said dams.

65. The mixer of claims 49, 50, 51 or 52 further comprising circumferential dams in the interior of said casing, said rotors being aligned with the spaces between said dams, said rotors extending beyond the interior edge of said dams, and a plurality of stators extending into said mixing zone from said dams.

66. The mixer of claims 49, 50, 51 or 52 further comprising said mixing zone being an annular space in which the interior surface of said space has a radius of at least one half of the radius of the exterior surface of said space, circumferential dams in the interior of said casing, said rotors being aligned with the spaces between said dams, said rotors extending beyond the interior edge of said dams, and a plurality of stators extending into said mixing zone from said dams.

67. The mixer of claims 49, 50, 51 or 52 further comprising said trailing edge has a radius of curvature in the range of 0.5 to 15 mm, circumferential dams in the interior of said casing, said rotors being aligned with the spaces between said dams, said rotors extending beyond the interior edge of said dams, a plurality of stators extending into said mixing zone from said dams.

68. The mixer of claims 49, 50, 51 or 52 further comprising circumferential dams in the interior of said casing, said rotors being aligned with the spaces between said dams, said rotors extending beyond the interior edge of said dams, apertures in said mixer casing, said apertures being aligned with the spaces between said dams, and means for delivering said chemical to said apertures.

69. The mixer of claims 49, 50, 51 or 52 further comprising said mixing zone being an annular space in which the interior surface of said space has a radius of at least one half of the radius of the exterior surface of said space, circumferential dams in the interior of said casing, said rotors being aligned with the spaces between said dams, said rotors extending beyond the interior edge of said dams, apertures in said mixer casing, said apertures being aligned with the spaces between said dams, and means for delivering said chemical to said apertures.

70. The mixer of claims 49, 50, 51 or 52 further comprising said trailing edge has a radius of curvature in the range of 0.5 to 15 mm, circumferential dams in the interior of said casing, said rotors being aligned with the spaces between said dams, said rotors extending beyond the interior edge of said dams, apertures in said mixer casing, said apertures being aligned with the spaces between said dams, and means for delivering said chemical to said apertures.

71. The mixer of claims 49, 50, 51 or 52 further comprising circumferential dams in the interior of said casing, said rotors being aligned with the spaces between said dams, said rotors extending beyond the interior edge of said dams, a plurality of stators extending into said mixing zone from said dams, apertures in said mixer casing, said apertures being aligned with the spaces between said dams, and means for delivering said chemical to said apertures.

72. The mixer of claims 49, 50, 51 or 52 further comprising said mixing zone being an annular space in which the interior surface of said space has a radius of at least one half of the radius of the exterior surface of said space, circumferential dams in the interior of said casing, said rotors being aligned with the spaces between said dams, said rotors extending beyond the interior edge of said dams, a plurality of stators extending into said mixing zone from said dams, apertures in said mixer casing, said apertures being aligned with the spaces between said dams, and means for delivering said chemical to said apertures.

73. The mixer of claims 49, 50, 51 or 52 further comprising said trailing edge has a radius of curvature in the range of 0.5 to 15 mm, circumferential dams in the interior of said casing, said rotors being aligned with the spaces between said dams, said rotors extending beyond the interior edge of said dams, a plurality of stators extending into said mixing zone from said dams, apertures in said mixer casing, said apertures being aligned with the spaces between said dams, and means for delivering said chemical to said apertures.

means for delivering said chemical to said apertures.

* * * * *

UNITED STATES PATENT AND TRADEMARK OFFICE

CERTIFICATE OF CORRECTION

PATENT NO. : 4,303,470

DATED : December 1, 1981

INVENTOR(S) : Michael D. Meredith, et al.

It is certified that error appears in the above—identified patent and that said Letters Patent is hereby corrected as shown below:

Column 29, line 39, "pulp slurry is subject to" should read --mixing takes place under--

Column 30, line 43, insert word "said" before --swept--

Column 31, line 23, "claim" should read --claims--

Column 31, line 24, "having" should read --have--

Column 36, line 13, remove entire line (duplicate)

Signed and Sealed this

*Second* Day of *November 1982*

[SEAL]

*Attest:*

GERALD J. MOSSINGHOFF

*Attesting Officer* *Commissioner of Patents and Trademarks*